US010184334B2

(12) United States Patent
Betancourt-Pocaterra et al.

(10) Patent No.: US 10,184,334 B2
(45) Date of Patent: Jan. 22, 2019

(54) ANALYZING RESERVOIR USING FLUID ANALYSIS

(71) Applicant: Schlumberger Technology Corporation, Sugar Land, TX (US)

(72) Inventors: Soraya S. Betancourt-Pocaterra, Katy, TX (US); Dariusz Strapoc, Roissy-en-France (FR); Ivan Fornasier, Roissy-en-France (FR); Vinay K. Mishra, Katy, TX (US); Jesus Alberto Canas, Katy, TX (US); Oliver C. Mullins, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 189 days.

(21) Appl. No.: 14/966,689

(22) Filed: Dec. 11, 2015

(65) Prior Publication Data

US 2016/0168985 A1 Jun. 16, 2016

(51) Int. Cl.
*E21B 49/00* (2006.01)
*E21B 49/08* (2006.01)
(Continued)

(52) U.S. Cl.
CPC ..... *E21B 49/005* (2013.01)

(58) Field of Classification Search
CPC ..... G01V 1/40; E21B 49/005; E21B 49/08; E21B 49/006; E21B 49/10; E21B 49/087; E21B 44/00
(Continued)

(56) References Cited

U.S. PATENT DOCUMENTS 4,887,464 A 12/1989 Tannenbaum et al.
6,956,204 B2 10/2005 Dong et al.
(Continued)

FOREIGN PATENT DOCUMENTS

EP 2135914 A1 12/2009
WO 2008017949 A1 2/2008
(Continued)

OTHER PUBLICATIONS

Extended European Search Report issued in related EP application 15197751.9 dated Apr. 15, 2016, 8 pages.
(Continued)

*Primary Examiner* — Manish S Shah
*Assistant Examiner* — Suman K Nath
(74) *Attorney, Agent, or Firm* — Mitchell M. Blakely

(57) ABSTRACT

Various implementations directed to analyzing a reservoir using fluid analysis are provided. In one implementation, a method may include determining mud gas logging (MGL) data based on drilling mud associated with a wellbore traversing a reservoir of interest. The method may also include determining first downhole fluid analysis (DFA) data based on a first reservoir fluid sample obtained at a first measurement station in the wellbore. The method may further include determining predicted DFA data for the wellbore based on the first DFA data. The method may additionally include determining second DFA data based on a second reservoir fluid sample obtained at a second measurement station in the wellbore. The method may further include analyzing the reservoir based on a comparison of the MGL data and a comparison of the second DFA data to the predicted DFA data.

18 Claims, 14 Drawing Sheets

(51) Int. Cl.

| | |
|---|---|
| *E21B 49/06* | (2006.01) |
| *E21B 49/10* | (2006.01) |
| *G01V 1/40* | (2006.01) |
| *E21B 44/00* | (2006.01) |

(58) Field of Classification Search
USPC ..... 73/152.06, 154.06, 152.11, 152.12; 702/9; 166/264
See application file for complete search history.

(56) References Cited

U.S. PATENT DOCUMENTS

| | | | | |
|---|---|---|---|---|
| 7,075,063 | B2 | 7/2006 | Dong et al. | |
| 7,081,615 | B2 | 7/2006 | Betancourt et al. | |
| 7,529,626 | B1 * | 5/2009 | Ellis | G01N 33/241 702/9 |
| 7,788,972 | B2 | 9/2010 | Terabayashi et al. | |
| 7,996,154 | B2 | 8/2011 | Zuo et al. | |
| 8,061,444 | B2 | 11/2011 | Mullins et al. | |
| 8,165,817 | B2 | 4/2012 | Betancourt et al. | |
| 2007/0119244 | A1 | 5/2007 | Goodwin et al. | |
| 2008/0147326 | A1 | 6/2008 | Ellis | |
| 2011/0088895 | A1 | 4/2011 | Pop et al. | |
| 2011/0139454 | A1 | 6/2011 | Shindgikar et al. | |
| 2012/0198915 | A1 | 8/2012 | Richards | |
| 2012/0215364 | A1 * | 8/2012 | Rossi | E21B 43/121 700/281 |
| 2013/0087698 | A1 | 4/2013 | Pomerantz et al. | |
| 2014/0238670 | A1 * | 8/2014 | Pop | E21B 7/04 166/264 |

FOREIGN PATENT DOCUMENTS

| | | | |
|---|---|---|---|
| WO | 2009/142840 | A2 | 11/2009 |
| WO | 2009142873 | A1 | 11/2009 |
| WO | 2010/059601 | A2 | 5/2010 |
| WO | 2014160793 | A1 | 10/2014 |

OTHER PUBLICATIONS

International Search Report and Written Opinion issued in related PCT application PCT/US2014/069794 dated Aug. 21, 2015, 17 pages.

International Preliminary Report on Patentability for the equivalent International patent application PCT/US2014/069794 dated Jun. 22, 2017.

Communication pursuant to Article 94(3) EPC for the equivalent European patent application 15197751.9 dated Aug. 4, 2017.

Mullins, et al., "The Dynamics of Reservoir Fluids and Their Substantial Systematic Variations," SPWLA 55th Annual Logging Symposium, May 18-22, 2014, pp. 1-18.

Communication pursuant to Article 94(3) for the equivalent European patent application 15197751.9 dated Mar. 28, 2017.

Office Action for the equivalent Mexican patent application MX/a/2015/016991 dated Mar. 26, 2018.

* cited by examiner

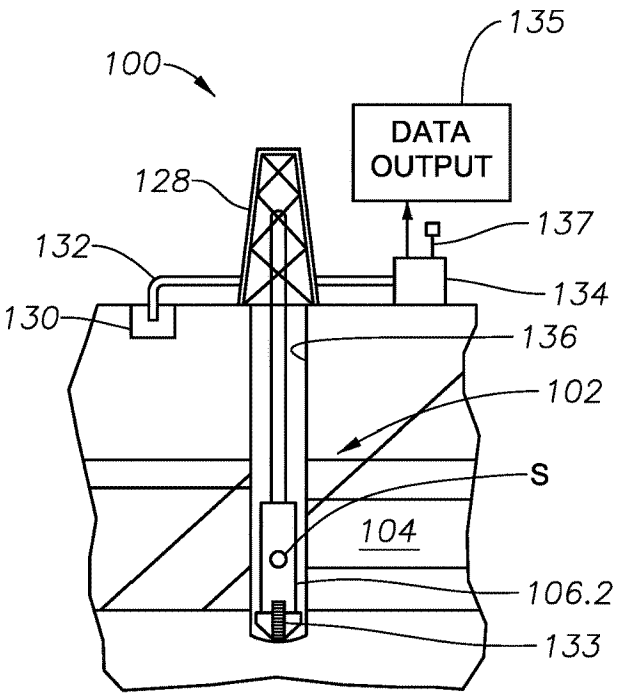
FIG. 1.2
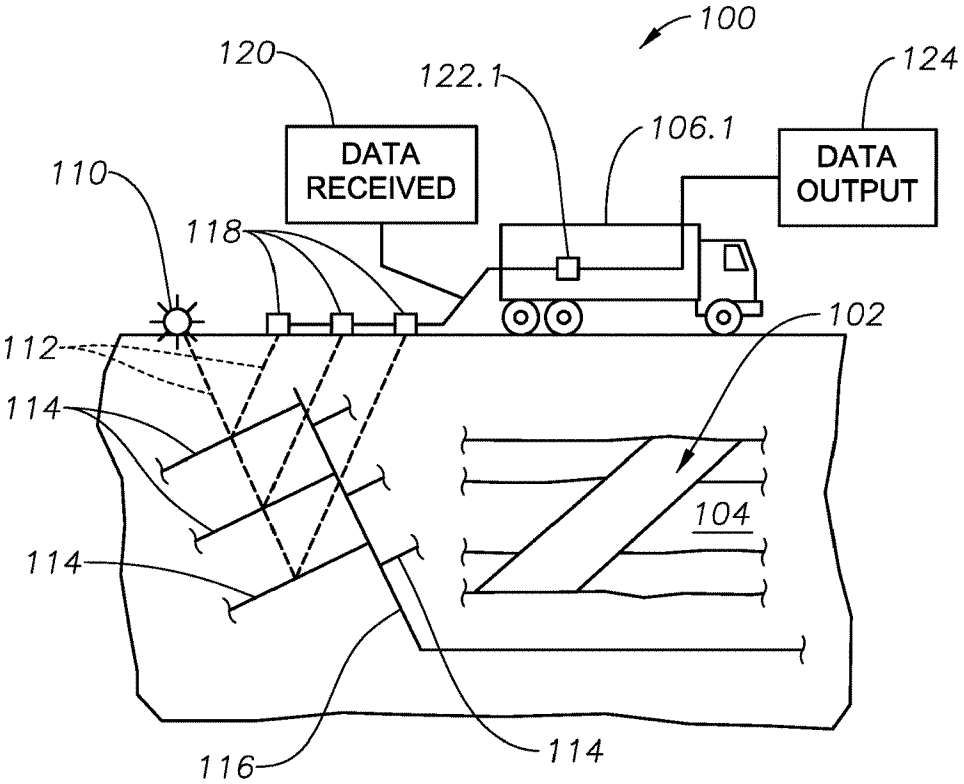
FIG. 1.1

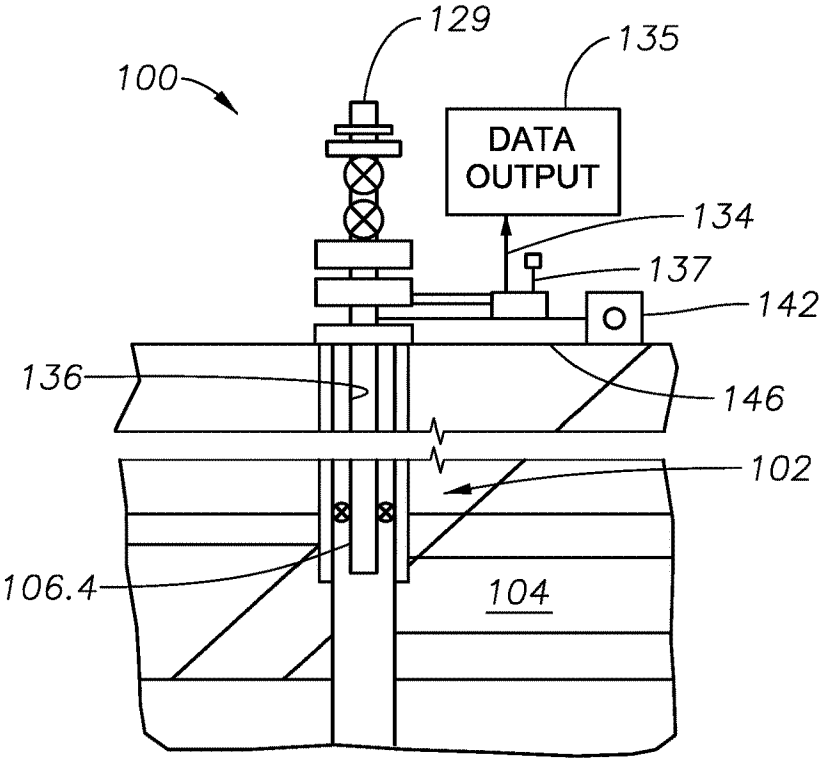
FIG. 1.4
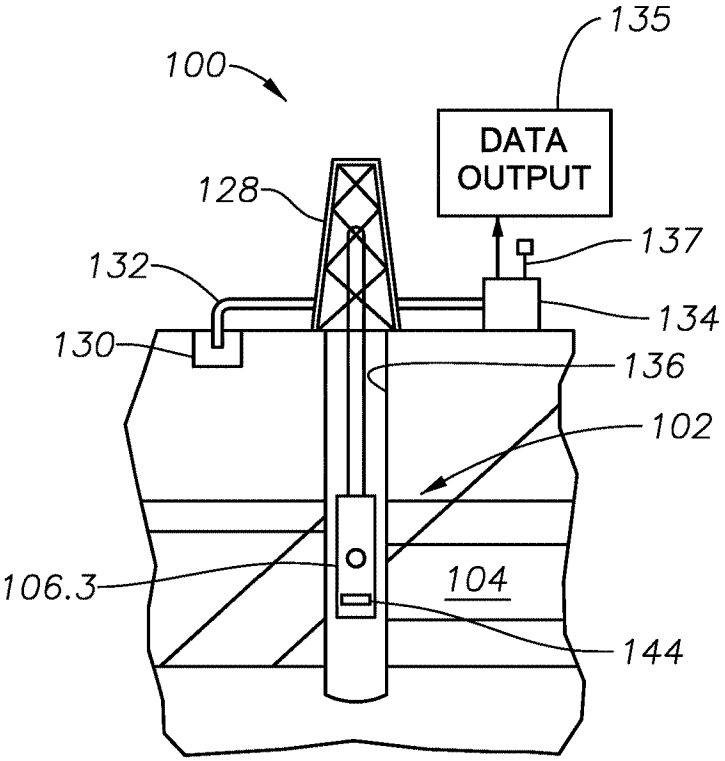
FIG. 1.3

ANALYZING RESERVOIR USING FLUID ANALYSIS

BACKGROUND

Operations, such as surveying, drilling, wireline testing, completions, and production, may involve various subsurface activities used to locate and gather hydrocarbons from a subterranean reservoir. One or more oil or gas wells may be positioned in the subterranean reservoir, where the wells may be provided with tools capable of advancing into the ground and removing hydrocarbons from the subterranean reservoir. Production facilities may be positioned at surface locations to collect the hydrocarbons from the wells. In particular, a reservoir fluid containing these hydrocarbons may be drawn from the subterranean reservoir and passed to the production facilities using equipment and other transport mechanisms, such as tubing.

During and/or after a drilling operation, evaluations may be performed on the reservoir for various purposes, such as to manage the production of hydrocarbons from the reservoir. In one scenario, formation evaluation may involve drawing fluid from the reservoir into a downhole tool for testing and/or sampling. Various devices, such as probes and/or packers, may be extended from the downhole tool to isolate a region of the wellbore wall, and thereby establish fluid communication with the reservoir surrounding the wellbore. Fluid may then be drawn into the downhole tool using the probe and/or packer. Within the downhole tool, the fluid may be directed to one or more fluid analyzers and sensors that may detect properties of the fluid. The properties of the fluid may be used to determine reservoir architecture, connectivity, compositional gradients, and/or the like.

SUMMARY

Various implementations directed to analyzing a reservoir using fluid analysis are provided. In one implementation, a method may include determining mud gas logging (MGL) data based on drilling mud associated with a wellbore traversing a reservoir of interest. The method may also include determining first downhole fluid analysis (DFA) data based on a first reservoir fluid sample obtained at a first measurement station in the wellbore. The method may further include determining predicted DFA data for the wellbore based on the first DFA data. The method may additionally include determining second DFA data based on a second reservoir fluid sample obtained at a second measurement station in the wellbore. The method may further include analyzing the reservoir based on a comparison of the MGL data and a comparison of the second DFA data to the predicted DFA data.

In another implementation, a well site system may include one or more degassers configured to extract gas from drilling mud associated with a wellbore traversing a reservoir of interest. The well site system may also include one or more gas analyzers configured to interact with the one or more degassers and to generate data relating to the extracted gas. The well site system may further include one or more downhole tools configured to obtain a first reservoir fluid sample at a first measurement station in the wellbore and a second reservoir fluid sample at a second measurement station in the wellbore. The well site system may additionally include one or more computing systems having a processor and a memory. The memory may include program instructions which, when executed by the processor, cause the processor to determine MGL data based on the data relating to the extracted gas. The program instructions may also cause the processor to determine first downhole fluid analysis DFA data based on the first reservoir fluid sample. The program instructions may further cause the processor to determine predicted DFA data for the first wellbore based on the first DFA data. The program instructions may additionally cause the processor to determine second DFA data based on the second reservoir fluid sample. The program instructions may further cause the processor to analyze the reservoir based on a comparison of the MGL data and a comparison of the second DFA data to the predicted DFA data.

In yet another implementation, a method may include determine mud gas logging MGL data based on drilling mud associated with a first wellbore and a second wellbore both traversing a reservoir of interest. The method may also include determining first downhole fluid analysis DFA data based on a first reservoir fluid sample obtained at a first measurement station in a first wellbore. The method may further include determining predicted DFA data for the first wellbore based on the first DFA data. The method may additionally include determining second DFA data based on a second reservoir fluid sample obtained at a second measurement station in a second wellbore. The method may further include analyzing the reservoir based on a comparison of the MGL data and a comparison of the second DFA data to the predicted DFA data.

The above referenced summary section is provided to introduce a selection of concepts in a simplified form that are further described below in the detailed description section. The summary is not intended to be used to limit the scope of the claimed subject matter. Furthermore, the claimed subject matter is not limited to implementations that solve any disadvantages noted in any part of this disclosure. Indeed, the systems, methods, processing procedures, techniques, and workflows disclosed herein may complement or replace conventional methods for identifying, isolating, and/or processing various aspects of seismic signals or other data that is collected from a subsurface region or other multidimensional space, including time-lapse seismic data collected in a plurality of surveys.

BRIEF DESCRIPTION OF THE DRAWINGS

Implementations of various techniques will hereafter be described with reference to the accompanying drawings. It should be understood, however, that the accompanying drawings illustrate the various implementations described herein and are not meant to limit the scope of various techniques described herein.

FIGS. 1.1-1.4 illustrate simplified, schematic views of an oilfield having subterranean formation containing reservoir therein in accordance with implementations of various technologies and techniques described herein.

DETAILED DESCRIPTION

Figure 2:
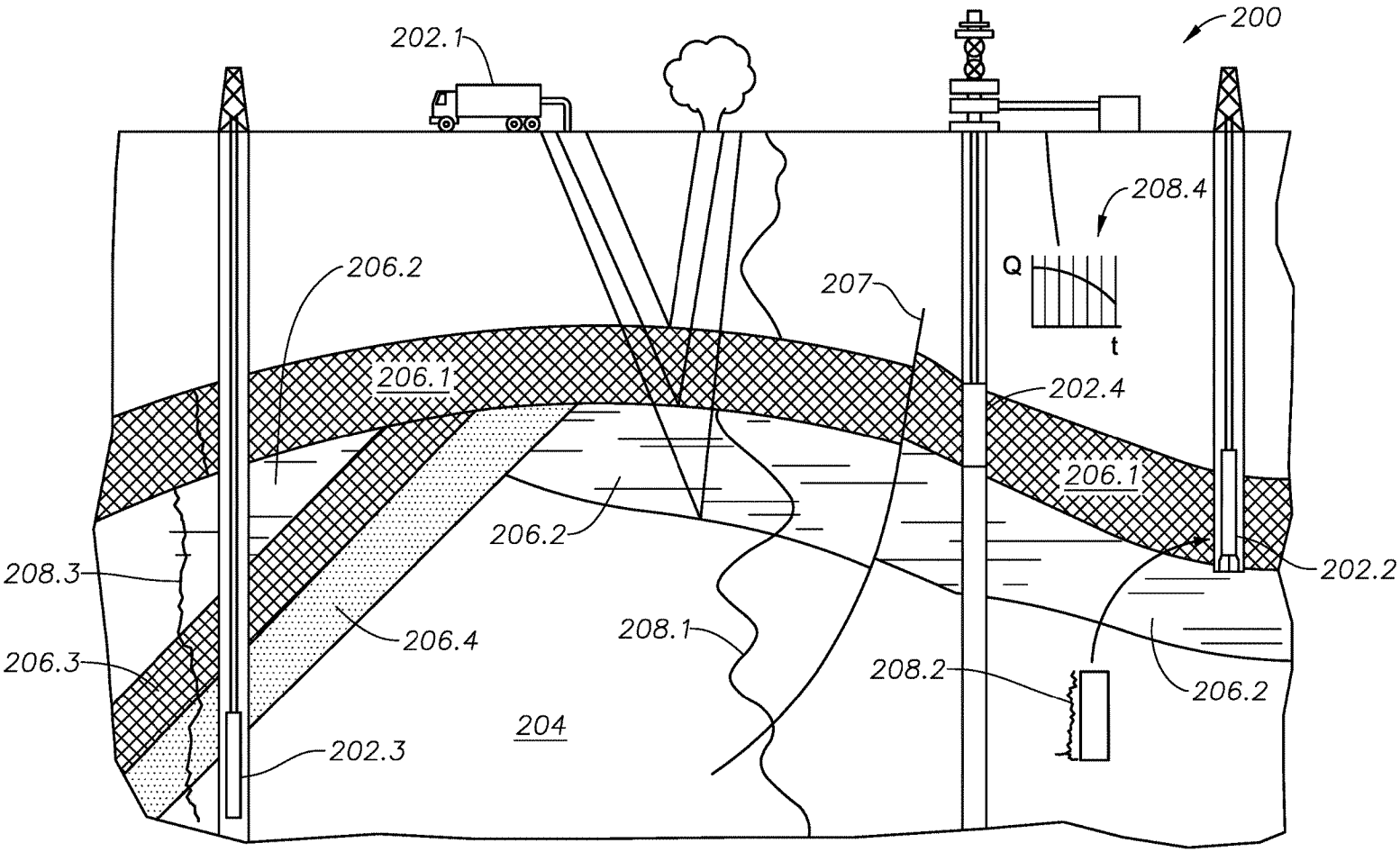
FIG. 2 illustrates a schematic view, partially in cross section of an oilfield having data acquisition tools positioned at various locations along the oilfield for collecting data of a subterranean formation in accordance with implementations of various technologies and techniques described herein.

The discussion below is directed to certain specific implementations. It is to be understood that the discussion below is for the purpose of enabling a person with ordinary skill in the art to make and use any subject matter defined now or later by the patent "claims" found in any issued patent herein.

It is specifically intended that the claims not be limited to the implementations and illustrations contained herein, but include modified forms of those implementations including portions of the implementations and combinations of elements of different implementations as come within the scope of the following claims.

Reference will now be made in detail to various implementations, examples of which are illustrated in the accompanying drawings and figures. In the following detailed description, numerous specific details are set forth in order to provide a thorough understanding of the present disclosure. However, it will be apparent to one of ordinary skill in the art that the present disclosure may be practiced without these specific details. In other instances, well-known methods, procedures, components, circuits and networks have not been described in detail so as not to obscure aspects of the embodiments.

It will also be understood that, although the terms first, second, etc. may be used herein to describe various elements, these elements should not be limited by these terms. These terms are used to distinguish one element from another. For example, a first object could be termed a second object, and, similarly, a second object could be termed a first object, without departing from the scope of the claims. The first object and the second object are both objects, respectively, but they are not to be considered the same object.

The terminology used in the description of the present disclosure herein is for the purpose of describing particular implementations and is not intended to be limiting of the present disclosure. As used in the description of the present disclosure and the appended claims, the singular forms "a," "an" and "the" are intended to include the plural forms as well, unless the context clearly indicates otherwise. It will also be understood that the term "and/or" as used herein refers to and encompasses one or more possible combinations of one or more of the associated listed items. It will be further understood that the terms "includes" and/or "including," when used in this specification, specify the presence of stated features, integers, operations, elements, and/or components, but do not preclude the presence or addition of one or more other features, integers, operations, elements, components and/or groups thereof.

As used herein, the terms "up" and "down"; "upper" and "lower"; "upwardly" and downwardly"; "below" and "above"; and other similar terms indicating relative positions above or below a given point or element may be used in connection with some implementations of various technologies described herein. However, when applied to equipment and methods for use in wells that are deviated or horizontal, or when applied to equipment and methods that when arranged in a well are in a deviated or horizontal orientation, such terms may refer to a left to right, right to left, or other relationships as appropriate.

It should also be noted that in the development of any such actual implementation, numerous decisions specific to circumstance may be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The terminology and phraseology used herein is solely used for descriptive purposes and should not be construed as limiting in scope. Language such as "having," "containing," or "involving," and variations thereof, is intended to be broad and encompass the subject matter listed thereafter, equivalents, and additional subject matter not recited.

Furthermore, the description and examples are presented solely for the purpose of illustrating the different embodiments, and should not be construed as a limitation to the scope and applicability. While any composition or structure may be described herein as having certain materials, it should be understood that the composition could optionally include two or more different materials. In addition, the composition or structure may also include some components other than the ones already cited. It should also be understood that throughout this specification, when a range is described as being useful, or suitable, or the like, it is intended that any value within the range, including the end points, is to be considered as having been stated. Furthermore, respective numerical values should be read once as modified by the term "about" (unless already expressly so modified) and then read again as not to be so modified unless otherwise stated in context. For example, "a range of from 1 to 10" is to be read as indicating a respective possible number along the continuum between about 1 and about 10. In other words, when a certain range is expressed, even if a few specific data points are explicitly identified or referred to within the range, or even when no data points are referred to within the range, it is to be understood that the inventors appreciate and understand that any data points within the range are to be considered to have been specified, and that the inventors have possession of the entire range and points within the range.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context.

One or more implementations of various techniques for analyzing a reservoir using fluid analysis will now be described in more detail with reference to FIGS. 1-13 in the following paragraphs.

Production Environment

FIGS. 1.1-1.4 illustrate simplified, schematic views of a production field 100 having subterranean formation 102 containing reservoir 104 therein in accordance with implementations of various technologies and techniques described herein. The production field 100 may be an oilfield, a gas field, and/or the like. FIG. 1.1 illustrates a survey operation being performed by a survey tool, such as seismic truck 106.1, to measure properties of the subterranean formation 102. The survey operation may be a seismic survey operation for producing sound vibrations. In FIG. 1.1, one such sound vibration, e.g., sound vibration 112 generated by source 110, may reflect off horizons 114 in earth formation 116. A set of sound vibrations may be received by sensors, such as geophone-receivers 118, situated on the earth's surface. The data received 120 may be provided as input data to a computer 122.1 of a seismic truck 106.1, and responsive to the input data, computer 122.1 generates seismic data output 124. This seismic data output may be stored, transmitted or further processed as desired, for example, by data reduction.

FIG. 1.2 illustrates a drilling operation being performed by drilling tools 106.2 suspended by rig 128 and advanced into subterranean formations 102 to form wellbore 136. Mud pit 130 may be used to draw drilling mud into the drilling tools via flow line 132 for circulating drilling mud down through the drilling tools, then up wellbore 136 and back to the surface. The drilling mud may be filtered and returned to the mud pit. A circulating system may be used for storing, controlling, or filtering the flowing drilling mud. The drilling tools may be advanced into subterranean formations 102 to reach reservoir 104. Each well may target one or more reservoirs. The drilling tools may be adapted for measuring downhole properties using logging while drilling tools. The logging while drilling tools may also be adapted for taking core sample 133 as shown.

Computer facilities may be positioned at various locations about the production field 100 (e.g., the surface unit 134) and/or at remote locations. Surface unit 134 may be used to communicate with the drilling tools and/or offsite operations, as well as with other surface or downhole sensors. Surface unit 134 may be capable of communicating with the drilling tools to send commands to the drilling tools, and to receive data therefrom. Surface unit 134 may also collect data generated during the drilling operation and produce data output 135, which may then be stored or transmitted.

Sensors (S), such as gauges, may be positioned about production field 100 to collect data relating to various production field operations as described previously. As shown, sensor (S) may be positioned in one or more locations in the drilling tools and/or at rig 128 to measure drilling parameters, such as weight on bit, torque on bit, pressures, temperatures, flow rates, compositions, rotary speed, and/or other parameters of the field operation. Sensors (S) may also be positioned in one or more locations in the circulating system.

Drilling tools 106.2 may include a bottom hole assembly (BHA) (not shown), generally referenced, near the drill bit (e.g., within several drill collar lengths from the drill bit). The bottom hole assembly may include capabilities for measuring, processing, and storing information, as well as communicating with surface unit 134. The bottom hole assembly may further include drill collars for performing various other measurement functions.

The bottom hole assembly may include a communication subassembly that communicates with surface unit 134. The communication subassembly may be adapted to send signals to and receive signals from the surface using a communications channel such as mud pulse telemetry, electro-magnetic telemetry, or wired drill pipe communications. The communication subassembly may include, for example, a transmitter that generates a signal, such as an acoustic or electromagnetic signal, which is representative of the measured drilling parameters. It may be appreciated by one of skill in the art that a variety of telemetry systems may be employed, such as wired drill pipe, electromagnetic or other known telemetry systems.

The wellbore may be drilled according to a drilling plan that is established prior to drilling. The drilling plan may set forth equipment, pressures, trajectories and/or other parameters that define the drilling process for the well site. The drilling operation may then be performed according to the drilling plan. However, as information is gathered, the drilling operation may need to deviate from the drilling plan. Additionally, as drilling or other operations are performed, the subsurface conditions may change. The earth model may also need adjustment as new information is collected.

The data gathered by sensors (S) may be collected by surface unit 134 and/or other data collection sources for analysis or other processing. The data collected by sensors (S) may be used alone or in combination with other data. The data may be collected in one or more databases and/or transmitted on or offsite. The data may be historical data, real time data, or combinations thereof. The real time data may be used in real time, or stored for later use. The data may also be combined with historical data or other inputs for further analysis. The data may be stored in separate databases, or combined into a single database.

Surface unit 134 may include transceiver 137 to allow communications between surface unit 134 and various portions of the production field 100 or other locations. Surface unit 134 may also be provided with or functionally connected to one or more controllers (not shown) for actuating mechanisms at production field 100. Surface unit 134 may then send command signals to production field 100 in response to data received. Surface unit 134 may receive commands via transceiver 137 or may itself execute commands to the controller. A processor may be provided to analyze the data (locally or remotely), make the decisions and/or actuate the controller. In this manner, production field 100 may be selectively adjusted based on the data collected. This technique may be used to optimize portions of the field operation, such as controlling drilling, weight on bit, pump rates, or other parameters. These adjustments may be made automatically based on computer protocol, and/or manually by an operator. In some cases, well plans may be adjusted to select optimum operating conditions, or to avoid problems.

FIG. 1.3 illustrates a wireline operation being performed by wireline tool 106.3 suspended by rig 128 and into wellbore 136 of FIG. 1.2. Wireline tool 106.3 may be adapted for deployment into wellbore 136 for generating well logs, performing downhole tests and/or collecting samples. Wireline tool 106.3 may be used to provide another method and apparatus for performing a seismic survey operation. Wireline tool 106.3 may, for example, have an explosive, radioactive, electrical, or acoustic energy source 144 that sends and/or receives electrical signals to surrounding subterranean formations 102 and fluids therein.

Wireline tool 106.3 may be operatively connected to, for example, geophones 118 and a computer 122.1 of a seismic truck 106.1 of FIG. 1.1. Wireline tool 106.3 may also provide data to surface unit 134. Surface unit 134 may collect data generated during the wireline operation and may produce data output 135 that may be stored or transmitted. Wireline tool 106.3 may be positioned at various depths in the wellbore 136 to provide a survey or other information relating to the subterranean formation 102.

Sensors (S), such as gauges, may be positioned about production field 100 to collect data relating to various field operations as described previously. As shown, sensor S may be positioned in wireline tool 106.3 to measure downhole parameters which relate to, for example porosity, permeability, fluid composition and/or other parameters of the field operation.

FIG. 1.4 illustrates a production operation being performed by production tool 106.4 deployed from a production unit or Christmas tree 129 and into completed wellbore 136 for drawing fluid from the downhole reservoirs into surface facilities 142. The fluid flows from reservoir 104 through perforations in the casing (not shown) and into production tool 106.4 in wellbore 136 and to surface facilities 142 via gathering network 146.

Sensors (S), such as gauges, may be positioned about production field 100 to collect data relating to various field operations as described previously. As shown, the sensor (S) may be positioned in production tool 106.4 or associated equipment, such as Christmas tree 129, gathering network 146, surface facility 142, and/or the production facility, to measure fluid parameters, such as fluid composition, flow rates, pressures, temperatures, and/or other parameters of the production operation.

Production may also include injection wells for added recovery. One or more gathering facilities may be operatively connected to one or more of the well sites for selectively collecting downhole fluids from the well site(s).

While FIGS. 1.2-1.4 illustrate tools used to measure properties of a production field, such as an oilfield or gas field, it may be appreciated that the tools may be used in connection with other operations, such as mines, aquifers, storage, or other subterranean facilities. Also, while certain data acquisition tools are depicted, it may be appreciated that various measurement tools capable of sensing parameters, such as seismic two-way travel time, density, resistivity, production rate, etc., of the subterranean formation and/or its geological formations may be used. Various sensors (S) may be located at various positions along the wellbore and/or the monitoring tools to collect and/or monitor the desired data. Other sources of data may also be provided from offsite locations.

The field configurations of FIGS. 1.1-1.4 may be an example of a field usable with oilfield or gas field application frameworks. At least part of the production field 100 may be on land, water, and/or sea. Also, while a single field measured at a single location may be depicted, oilfield or gas field applications may be utilized with any combination of one or more oilfields and/or gas field, one or more processing facilities and one or more well sites.

FIG. 2 illustrates a schematic view, partially in cross section of production field 200 having data acquisition tools 202.1, 202.2, 202.3 and 202.4 positioned at various locations along production field 200 for collecting data of subterranean formation 204 in accordance with implementations of various technologies and techniques described herein. The production field 200 may be an oilfield, a gas field, and/or the like. Data acquisition tools 202.1-202.4 may be the same as data acquisition tools 106.1-106.4 of FIGS. 1.1-1.4, respectively, or others not depicted. As shown, data acquisition tools 202.1-202.4 may generate data plots or measurements 208.1-208.4, respectively. These data plots may be depicted along production field 200 to demonstrate the data generated by the various operations.

Data plots 208.1-208.3 may be examples of static data plots that may be generated by data acquisition tools 202.1-202.3, respectively; however, it should be understood that data plots 208.1-208.3 may also be data plots that are updated in real time. These measurements may be analyzed to better define the properties of the formation(s) and/or determine the accuracy of the measurements and/or for checking for errors. The plots of each of the respective measurements may be aligned and scaled for comparison and verification of the properties.

Static data plot 208.1 may be a seismic two-way response over a period of time. Static plot 208.2 may be core sample data measured from a core sample of the formation 204. The core sample may be used to provide data, such as a graph of the density, porosity, permeability, or some other physical property of the core sample over the length of the core. Tests for density and viscosity may be performed on the fluids in the core at varying pressures and temperatures. Static data plot 208.3 may be a logging trace that may provide a resistivity or other measurement of the formation at various depths.

A production decline curve or graph 208.4 may be a dynamic data plot of the fluid flow rate over time. The production decline curve may provide the production rate as a function of time. As the fluid flows through the wellbore, measurements may be taken of fluid properties, such as flow rates, pressures, composition, etc.

Other data may also be collected, such as historical data, user inputs, economic information, and/or other measurement data and other parameters of interest. As described below, the static and dynamic measurements may be analyzed and used to generate models of the subterranean formation to determine characteristics thereof. Similar measurements may also be used to measure changes in formation aspects over time.

The subterranean structure 204 may have a plurality of geological formations 206.1-206.4. As shown, this structure may have several formations or layers, including a shale layer 206.1, a carbonate layer 206.2, a shale layer 206.3 and a sand layer 206.4. A fault 207 may extend through the shale layer 206.1 and the carbonate layer 206.2. The static data acquisition tools may be adapted to take measurements and detect characteristics of the formations.

While a specific subterranean formation with specific geological structures is depicted, it may be appreciated that production field 200 may contain a variety of geological structures and/or formations, sometimes having extreme complexity. In some locations, such as below the water line, fluid may occupy pore spaces of the formations. Each of the measurement devices may be used to measure properties of the formations and/or its geological features. While each acquisition tool may be shown as being in specific locations in production field 200, it may be appreciated that one or more types of measurement may be taken at one or more locations across one or more fields or other locations for comparison and/or analysis.

The data collected from various sources, such as the data acquisition tools of FIG. 2, may then be processed and/or evaluated. The seismic data displayed in static data plot 208.1 from data acquisition tool 202.1 may be used by a geophysicist to determine characteristics of the subterranean formations and features. The core data shown in static plot 208.2 and/or log data from well log 208.3 may be used by a geologist to determine various characteristics of the subterranean formation. The production data from graph 208.4 may be used by the reservoir engineer to determine fluid flow reservoir characteristics. The data analyzed by the geologist, geophysicist and the reservoir engineer may be analyzed using modeling techniques.

Figure 3:
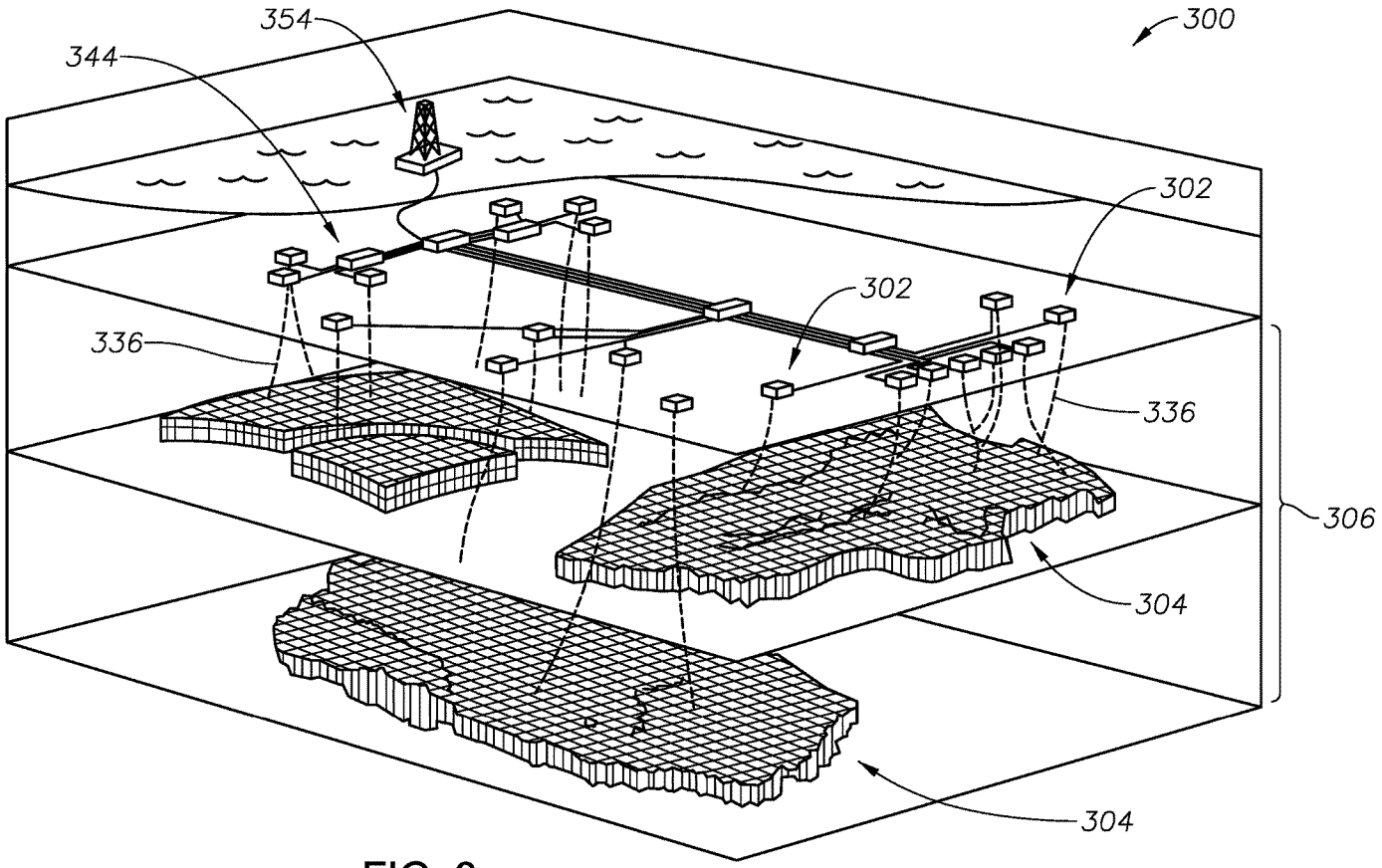
FIG. 3 illustrates an oilfield for performing production operations in accordance with implementations of various technologies and techniques described herein.

FIG. 3 illustrates a production field 300 for performing production operations in accordance with implementations of various technologies and techniques described herein. The production field 300 may be an oilfield, a gas field, and/or the like. As shown, the production field 300 may have a plurality of well sites 302 operatively connected to central processing facility 354. The production field configuration of FIG. 3 may not be intended to limit the scope of the production field application system. At least part of the production field may be on land and/or sea. Also, while a single production field with a single processing facility and a plurality of well sites is depicted, any combination of one or more production fields, one or more processing facilities and one or more well sites may be present.

Each well site 302 may have equipment that forms wellbore 336 into the earth. The wellbores may extend through subterranean formations 306 including reservoirs 304. These reservoirs 304 may contain fluids, such as hydrocarbons. The well sites may draw fluid from the reservoirs and pass them to the processing facilities via surface networks 344. The surface networks 344 may have tubing and control mechanisms for controlling the flow of fluids from the well site to processing facility 354.

Figure 4:
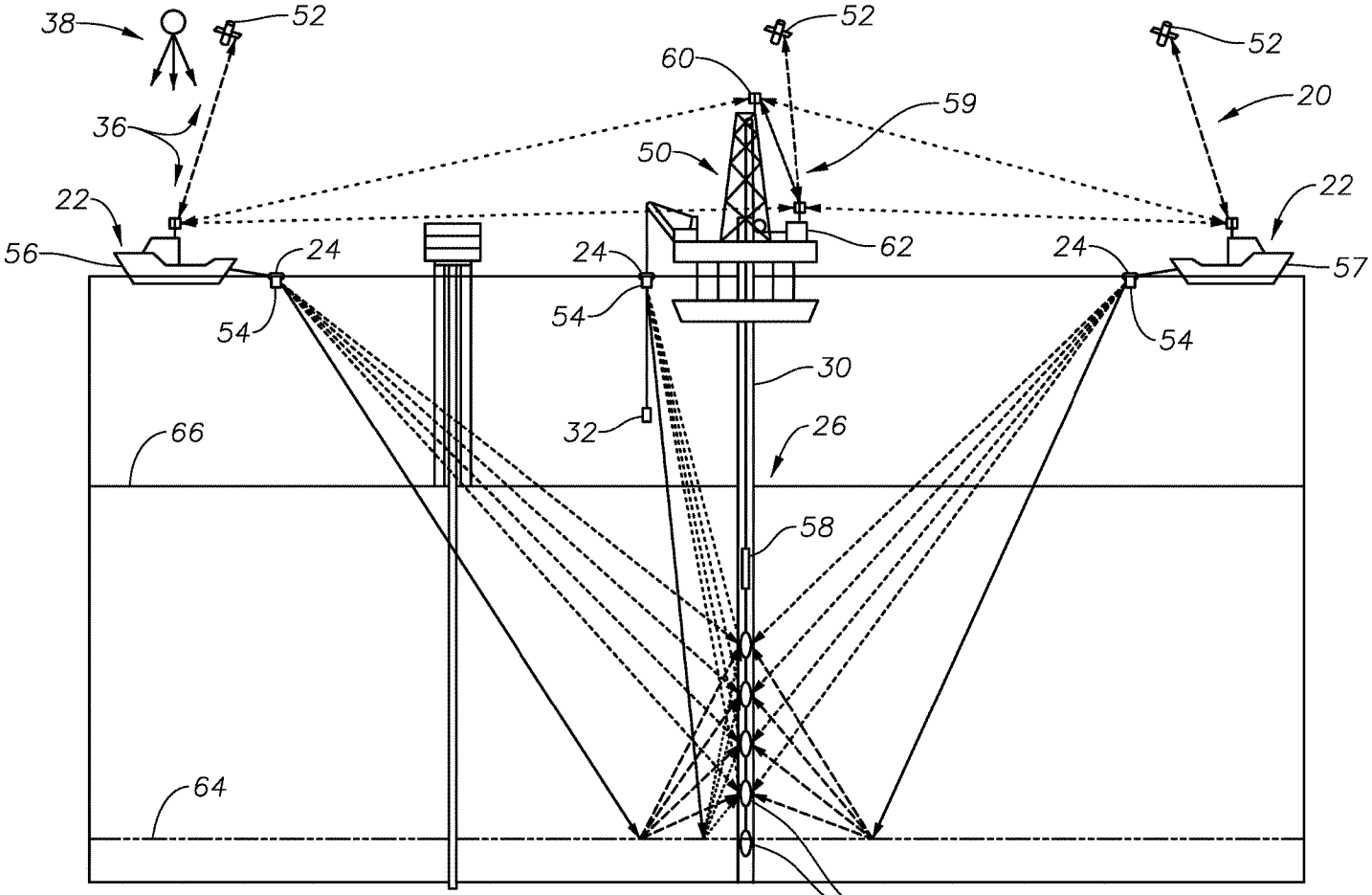
FIG. 4 illustrates a seismic system in accordance with implementations of various technologies and techniques described herein.

FIG. 4 illustrates a seismic system 20 in accordance with implementations of various technologies and techniques described herein. The seismic system 20 may include a plurality of tow vessels 22 that are employed to enable seismic profiling, e.g. three-dimensional vertical seismic profiling or rig/offset vertical seismic profiling. In FIG. 4, a marine system may include a rig 50, a plurality of vessels 22, and one or more acoustic receivers 28. Although a marine system is illustrated, other implementations of the disclosure may not be limited to this example. A person of ordinary skill in the art may recognize that land or offshore systems may be used.

Although two vessels 22 are illustrated in FIG. 4, a single vessel 22 with multiple source arrays 24 or multiple vessels 22 with single or multiple sources 24 may be used. In some implementations, at least one source and/or source array 24 may be located on the rig 50, as shown by the rig source in FIG. 4. As the vessels 22 travel on predetermined or systematic paths, their locations may be recorded through the use of navigation system 36. In some implementations, the navigation system 36 may utilize a global positioning system (GPS) 38 to record the position, speed, direction, and other parameters of the tow vessels 22.

As shown, the global positioning system 38 may utilize or work in cooperation with satellites 52 which operate on a suitable communication protocol, e.g. VSAT communications. The VSAT communications may be used, among other things, to supplement VHF and UHF communications. The GPS information can be independent of the VSAT communications and may be input to a processing system or other suitable processors to predict the future movement and position of the vessels 22 based on real-time information. In addition to predicting future movements, the processing system also can be utilized to provide directions and coordinates as well as to determine initial shot times, as described above. A control system effectively utilizes the processing system in cooperation with a source controller and a synchronization unit to synchronize the sources 24 with the downhole data acquisition system 26.

As shown, the one or more vessels 22 may respectively tow one or more acoustic sources/source arrays 24. The source arrays 24 include one or more seismic signal generators 54, e.g. air guns, configured to create a seismic and/or sonic disturbance. In the implementation illustrated, the tow vessels 22 comprise a master source vessel 56 (Vessel A) and a slave source vessel 57 (Vessel B). However, other numbers and arrangements of tow vessels 22 may be employed to accommodate the parameters of a given seismic profiling application. For example, one source 24 may be mounted at rig 50 (see FIG. 4) or at another suitable location, and both vessels 22 may serve as slave vessels with respect to the rig source 24 or with respect to a source at another location.

However, a variety of source arrangements and implementations may be used. When utilizing dithered timing between the sources, for example, the master and slave locations of the sources can be adjusted according to the parameters of the specific seismic profiling application. In some implementations, one of the source vessels 22 (e.g. source vessel A in FIG. 4) may serve as the master source vessel while the other source vessel 22 serves as the slave source vessel with dithered firing. However, an alternate source vessel 22 (e.g. source vessel B in FIG. 4) may serve as the master source vessel while the other source vessel 22 serves as the slave source vessel with dithered firing.

Similarly, the rig source 22 may serve as the master source while one of the source vessels 22 (e.g. vessel A) serves as the slave source vessel with dithered firing. The rig source 22 also may serve as the master source while the other source vessel 22 (e.g. vessel B) serves as the slave source vessel with dithered firing. In some implementations, the rig source 22 may serve as the master source while both of the source vessels 22 serve as slave source vessels each with dithered firings. These and other implementations may be used in achieving the desired synchronization of sources 22 with the downhole acquisition system 26.

The acoustic receivers 28 of data acquisition system 26 may be deployed in borehole 30 via a variety of delivery systems, such as wireline delivery systems, slickline delivery systems, and other suitable delivery systems. Although a single acoustic receiver 28 could be used in the borehole 30, a plurality of receivers 28, as shown, may be located in a variety of positions and orientations. The acoustic receivers 28 may be configured for sonic and/or seismic reception. Additionally, the acoustic receivers 28 may be communicatively coupled with processing equipment 58 located downhole. In one implementation, processing equipment 58 may comprise a telemetry system for transmitting data from acoustic receivers 28 to additional processing equipment 59 located at the surface, e.g. on the rig 50 and/or vessels 22.

Depending on the data communication system, surface processing equipment 59 may include a radio repeater 60, an acquisition and logging unit 62, and a variety of other and/or additional signal transfer components and signal processing components. The radio repeater 60 along with other components of processing equipment 59 may be used to communicate signals, e.g. UHF and/or VHF signals, between vessels 22 and rig 50 and to enable further communication with downhole data acquisition system 26.

It should be noted the UHF and VHF signals can be used to supplement each other. The UHF band may support a higher data rate throughput, but can be susceptible to obstructions and has less range. The VHF band may be less susceptible to obstructions and may have increased radio range but its data rate throughput is lower. In FIG. 4, the VHF communications may "punch through" an obstruction in the form of a production platform.

In some implementations, the acoustic receivers 28 may be coupled to surface processing equipment 59 via a hard-wired connection. In other implementations, wireless or optical connections may be employed. In still other implementations, combinations of coupling techniques may be employed to relay information received downhole via the acoustic receivers 28 to an operator and/or the control system described above, located at least in part at the surface.

In addition to providing raw or processed data uphole to the surface, the coupling system, e.g. downhole processing equipment 58 and surface processing equipment 59, may be designed to transmit data or instructions downhole to the acoustic receivers 28. For example, the surface processing equipment 59 may comprise a synchronization unit, which may coordinate the firing of sources 24, e.g. dithered (delayed) source arrays, with the acoustic receivers 28 located in borehole 30. In one implementation, the synchronization unit may use a coordinated universal time to ensure accurate timing. In some implementations, the coordinated universal time system may be employed in cooperation with global positioning system 38 to obtain UTC data from the GPS receivers of GPS system 38.

FIG. 4 illustrates one example of a system for performing seismic profiling that can employ simultaneous or near-simultaneous acquisition of seismic data. In one implementation, the seismic profiling may comprise three-dimensional vertical seismic profiling, but other applications may utilize rig and/or offset vertical seismic profiling or seismic profiling employing walkaway lines. An offset source can be provided by a source 24 located on rig 50, on a vessel 22, and/or on another vessel or structure. In one implementation, the vessels 22 may be substantially stationary.

In one implementation, the overall seismic system 20 may employ various arrangements of sources 24 on vessels 22 and/or rig 50 with each location having at least one source and/or source array 24 to generate acoustic source signals. The acoustic receivers 28 of downhole acquisition system 26 may be configured to receive the source signals, at least some of which are reflected off a reflection boundary 64 located beneath a sea bottom 66. The acoustic receivers 28 may generate data streams that are relayed uphole to a suitable processing system, e.g. the processing system described above, via downhole telemetry/processing equipment 58.

While the acoustic receivers 28 generate data streams, the navigation system 36 may determine a real-time speed, position, and direction of each vessel 22 and may estimate initial shot times accomplished via signal generators 54 of the appropriate source arrays 24. The source controller may be part of surface processing equipment 59 (located on rig 50, on vessels 22, or at other suitable locations) and may be designed to control firing of the acoustic source signals so that the timing of an additional shot time (e.g. a shot time via slave vessel 57) is based on the initial shot time (e.g. a shot time via master vessel 56) plus a dither value.

The synchronization unit of, for example, surface processing equipment 59, may coordinate the firing of dithered acoustic signals with recording of acoustic signals by the downhole acquisition system 26. The processor system may be configured to separate a data stream of the initial shot and a data stream of the additional shot via a coherency filter. As discussed above, however, other implementations may employ pure simultaneous acquisition and/or may not use separation of the data streams. In such implementations, the dither is effectively zero.

After an initial shot time at T=0 (T0) is determined, subsequent firings of acoustic source arrays 24 may be offset by a dither. The dithers can be positive or negative and sometimes are created as pre-defined random delays. Use of dithers facilitates the separation of simultaneous or near-simultaneous data sets to simplify the data processing. The ability to have the acoustic source arrays 24 fire in simultaneous or near-simultaneous patterns may reduce the overall amount of time for three-dimensional vertical seismic profiling source acquisition. This, in turn, may significantly reduce rig time. As a result, the overall cost of the seismic operation may be reduced, rendering the data intensive process much more accessible.

If the acoustic source arrays used in the seismic data acquisition are widely separated, the difference in move-outs across the acoustic receiver array of the wave fields generated by the acoustic sources 24 can be used to obtain a clean data image via processing the data without further special considerations. However, even when the acoustic sources 24 are substantially co-located in time, data acquired by any of the methods involving dithering of the firing times of the individual sources 24 described herein can be processed to a formation image leaving hardly any artifacts in the final image. This is accomplished by taking advantage of the incoherence of the data generated by one acoustic source 24 when seen in the reference time of the other acoustic source 24.

Attention is now directed to methods, techniques, and workflows for processing and/or transforming collected data that are in accordance with some implementations. Some operations in the processing procedures, methods, techniques, and workflows disclosed herein may be combined and/or the order of some operations may be changed. In the geosciences and/or other multi-dimensional data processing disciplines, various interpretations, sets of assumptions, and/or domain models such as velocity models, may be refined in an iterative fashion; this concept may be applicable to the procedures, methods, techniques, and workflows as discussed herein. This iterative refinement can include use of feedback loops executed on an algorithmic basis, such as via a computing system, as discussed later, and/or through manual control by a user who may make determinations regarding whether a given action, template, or model has become accurate.

Analyzing a Reservoir

As mentioned above, a reservoir disposed in a subterranean formation may contain hydrocarbons. In particular, the hydrocarbons may develop from the thermal cracking of organic matter deposited in source rocks as they are buried deeper in the earth's crust by the deposition of newer sediments. Fluids containing these hydrocarbons may eventually be expelled from the source rock and migrate, such as through faults and fractures, until they are trapped in a reservoir rock. Such movement of hydrocarbons may be referred to as a primary charge. In particular, reservoir fluids disposed in these reservoirs may contain the hydrocarbons, where the hydrocarbons may take the form of oil, gas condensate, and/or the like.

In one scenario, for reservoirs behaving as a closed system, if the movement of fluids ceases, then the reservoir fluids may eventually reach a state of chemical and thermodynamic equilibrium. Gravity may act as a force on the reservoir. In addition, depending on the length of the hydrocarbon column and the hydrocarbon composition, there may be composition gradients within the reservoir. However, some reservoirs may not behave as an ideal closed system as described above. Instead, one or a combination of the following situations may occur: geologic events may alter the reservoir structure after the primary charge, more thermally mature fluids may arrive to the reservoir, hydrocarbons may escape via flow channels or a compromised cap seal, biodegradation at sufficiently low temperature and mixing with biogenic methane, biogenic methane arriving at the reservoir, water washing, and/or the like. Such reservoirs may have reservoir fluids which exist in a state of non-equilibrium.

In another scenario, the reservoir may be compartmentalized such that it lacks a level of spatial connectivity within reservoir units (i.e., parts of the reservoir). A compartmentalized reservoir may consist of two or more compartments that effectively are not in hydraulic communication. Two types of reservoir compartmentalization may include vertical and lateral compartmentalization. Lateral compartmentalization may occur as a result of faulting or stratigraphic changes in the reservoir, while vertical compartmentalization may occur from sealing barriers such as shales.

Reservoir compartmentalization, as well as non-equilibrium hydrocarbon distribution, can significantly hinder production and can make the difference between an economically-viable field and an economically-nonviable field. Techniques to aid an operator to accurately describe reservoir compartments and their distribution, as well as non-equilibrium hydrocarbon distribution, can increase understanding of such reservoirs and ultimately raise production.

In one implementation, and as further described below, an integration of downhole fluid analysis and mud gas logging may be used to provide information that can be used to accurately detect compartmentalization and/or non-equilibrium hydrocarbon distribution in the reservoir of interest. In particular, downhole fluid analysis and mud gas logging techniques may be used to identify variations in fluid properties of the reservoir, which may in turn be used to detect compartmentalization and/or non-equilibrium hydrocarbon distribution in the reservoir.

Downhole Fluid Analysis

In order to identify variations in fluid properties of the reservoir via a downhole fluid analysis (DFA), one or more in situ reservoir fluid samples may be withdrawn using a downhole tool disposed within a wellbore. In particular, the reservoir fluid samples may be withdrawn from one or more reference points disposed in the wellbore. A reference point in the wellbore may hereinafter be referred to as a measurement station.

As further discussed below, the DFA may then be performed at one or more measurement stations to determine one or more fluid properties of the reservoir fluid, including, but not limited to, gas-oil ratio (GOR), fluid composition (e.g., fractional amounts of $C_1$, $C_2$, $C_3$-$C_5$, $C_{6+}$, $CO_2$, and the like), acidity of the fluids (e.g., pH), fluorescence, optical density, fluid resistivity, fluid density, and fluid viscosity. The downhole tool may also provide measurements of pressure, temperature, and mobility of the reservoir rock. As noted above, variations in such fluid properties may indicate compartmentalization and/or non-equilibrium hydrocarbon distribution in the reservoir.

The DFA may be performed on the reservoir fluid samples during drilling or thereafter. In one implementation, the reservoir fluid samples may be analyzed downhole during a pause in drilling operations, during which the downhole tool may acquire the fluid samples and transmit results of the DFA to an acquisition unit at the surface. In another implementation, the reservoir fluid samples may be analyzed on the surface after the drilling operations have finished, where the downhole tool may acquire the fluid samples and subsequently transmit the fluid samples to the surface for other fluid analysis to be performed. In yet another implementation, the DFA may be performed in real-time or substantially real-time.

System

Figure 5:
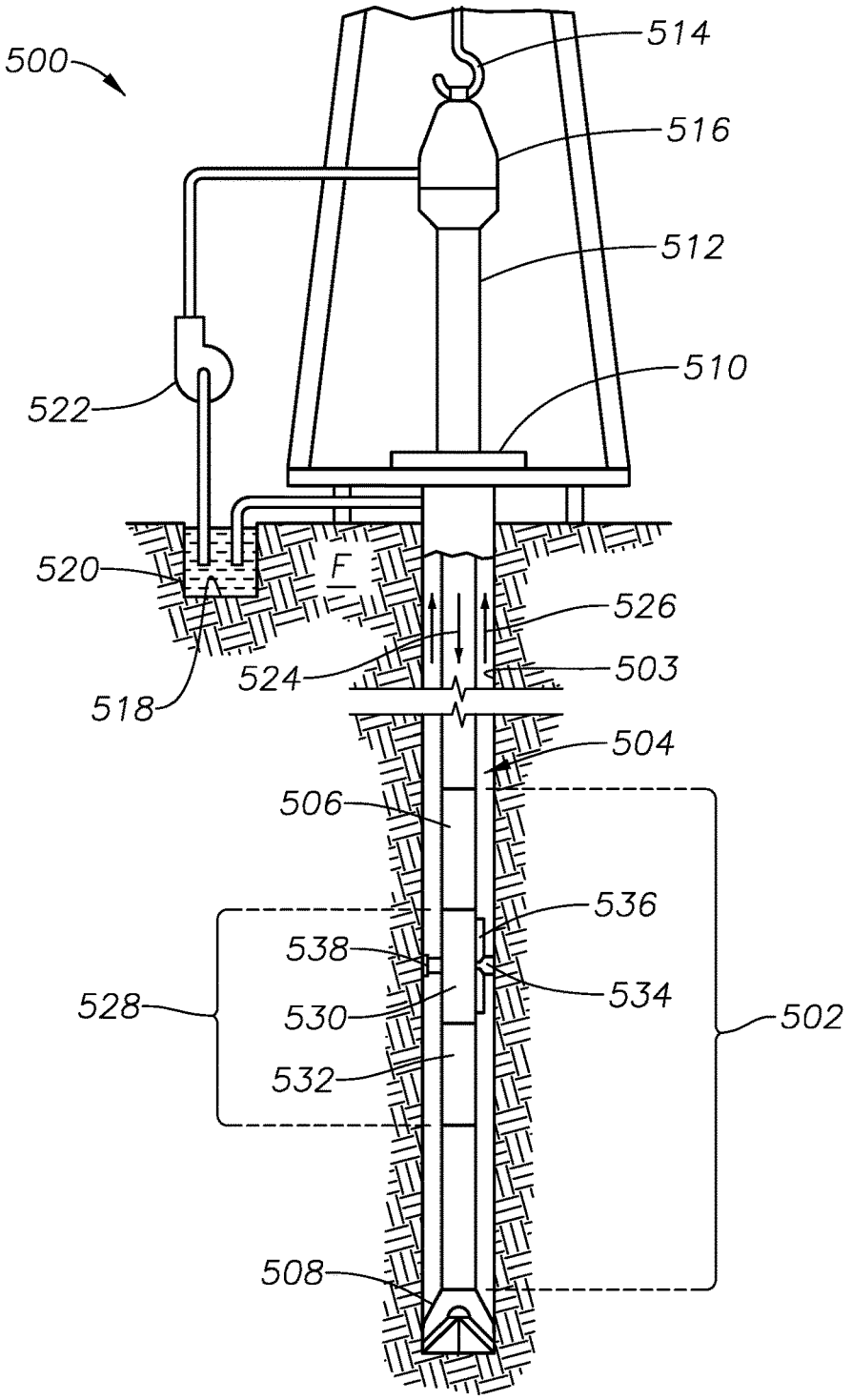
FIG. 5 illustrates a rig with a downhole tool in accordance with implementations of various technologies and techniques described herein.
Figure 6:
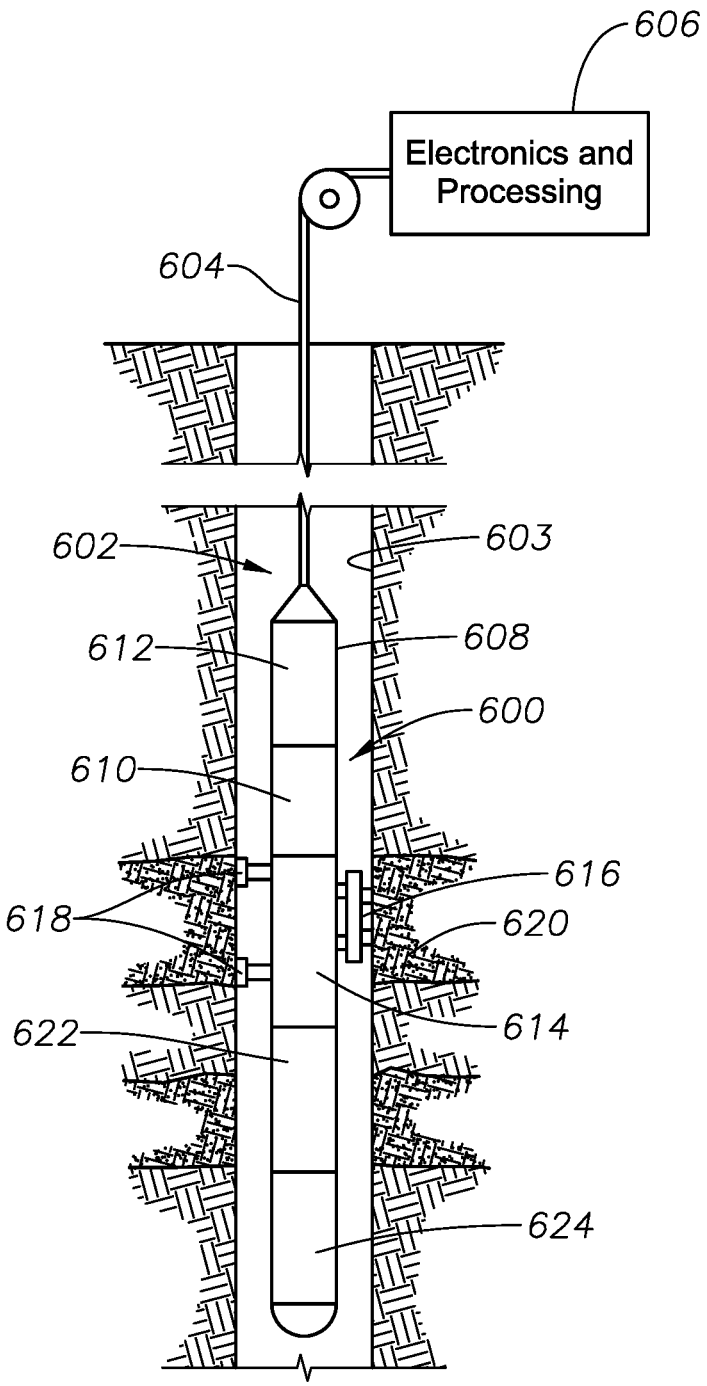
FIG. 6 illustrates a wireline downhole tool in accordance with implementations of various technologies and techniques described herein.
Figure 7:
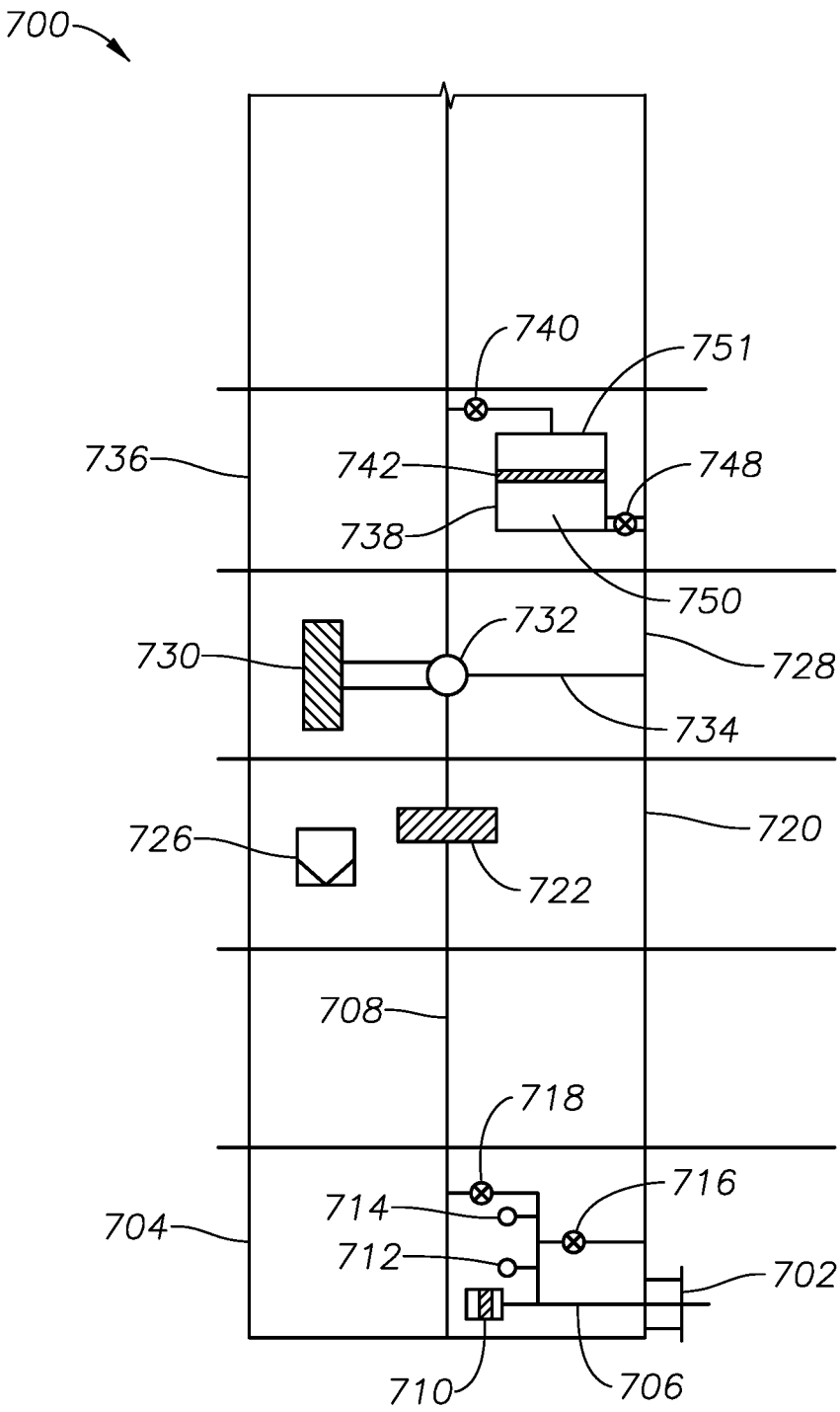
FIG. 7 illustrates a downhole tool in accordance with implementations of various technologies and techniques described herein.

FIGS. 5-7 illustrate various implementations of well site systems that may employ DFA systems and techniques. In one implementation, FIG. 5 illustrates a rig 500 with a downhole tool 502 in accordance with implementations of various technologies and techniques described herein. In particular, FIG. 5 depicts the downhole tool 502 as being suspended from the rig 500 and into a wellbore 504 via a drill string 506. The rig 500 may be similar to the rig 128 of FIGS. 1.2-1.3. The downhole tool 500 may have a drill bit 508 at its lower end that may be used to advance the downhole tool 500 into the formation, and may also be used to form the wellbore 504. The drill string 506 may be rotated by a rotary table 510 energized by a powering means (not shown), where the rotary table 510 may engage a kelly joint 512 at the upper end of the drill string 506. The drill string 506 may be suspended from a hook 514 attached to a traveling block (not shown). In particular, the drill string 506 may be suspended through the kelly joint 512 and a rotary swivel 516 that permits rotation of the drill string 506 relative to the hook 514. The rig 500 may be a land-based platform and derrick assembly used to form the wellbore 504 by rotary drilling. However, in other implementations, the rig 500 may be an offshore platform.

Drilling fluid or mud 518 may be stored in a pit 520 formed at the well site. A pump 522 may deliver the drilling fluid 518 to the interior of the drill string 506 via a port in the swivel 516, inducing the drilling fluid to flow downwardly through the drill string 506 as indicated by a directional arrow 524. The drilling fluid may exit the drill string 506 via ports in the drill bit 508, and then circulate upwardly through the region between the outside of the drill string and the wall of the wellbore, called the annulus, as indicated by directional arrows 526. The drilling fluid may lubricate the drill bit 508 and carry formation cuttings up to the surface as the fluid is returned to the pit 520 for recirculation.

The downhole tool 502 may sometimes be referred to as a bottom hole assembly ("BHA"), where the downhole tool 502 may be positioned near the drill bit 508. The BHA of FIG. 5 may be similar to the BHA of FIG. 1.2. The downhole tool 502 may include various components with capabilities, such as measuring, processing, and storing information, as well as communicating with the surface. A telemetry device (not shown) also may be provided for communicating with a surface unit (not shown).

The downhole tool 502 may also include a sampling system 528, where the sampling system 528 includes a fluid communication module 530 and a sampling module 532. The modules may be housed in a drill collar for performing various formation evaluation functions, such as pressure testing, sampling, and/or the like. As shown in FIG. 5, the fluid communication module 530 may be positioned adjacent to the sampling module 532. However, the position of the fluid communication module 530, as well as other modules, may vary in other implementations. Additional devices, such as pumps, gauges, sensor, monitors, and/or other devices usable in downhole sampling and/or testing may also be used. The additional devices may be incorporated into modules 530 and 532 or disposed within separate modules included within the sampling system 528.

The fluid communication module 530 may include a probe 534, where the probe 534 may be positioned in a stabilizer blade or rib 536. The probe 534 may include one or more inlets for receiving reservoir fluid and one or more flow lines (not shown) extending into the downhole tool for passing fluids through the tool. In another implementation, the probe 534 may include a single inlet designed to direct reservoir fluid into a flow line within the downhole tool. In yet another implementation, the probe may include multiple inlets that may be used for focused sampling. In such implementations, the probe may be connected to a sampling flow line, as well as to guard flow lines. The probe 534 may be movable between extended and retracted positions for selectively engaging a wall 503 of the wellbore 504 and acquiring fluid samples from a formation F. One or more setting pistons 538 may be provided to assist in positioning the fluid communication module 530 against the wellbore wall.

In another implementation, FIG. 6 illustrates a wireline downhole tool 600 in accordance with implementations of various technologies and techniques described herein. The downhole tool 600 may be suspended in a wellbore 602 from the lower end of a multi-conductor cable 604 that is spooled on a winch at the surface. The cable 604 may be communicatively coupled to an electronics and processing system 606. The downhole tool 600 may include an elongated body 608 that houses modules 610, 612, 614, 622, and 624. The modules 610, 612, 614, 622, and 624 may provide various functionalities, including, but not limited to, fluid sampling, pressure transient testing, fluid testing, operational control, communication, and/or the like. For example, the modules 610 and 612 may provide additional functionality such as fluid analysis (e.g., DFA), resistivity measurements, operational control, communications, coring, imaging, and/or the like.

As shown in FIG. 6, the module 614 may be a fluid communication module 614 that has a selectively extendable probe 616 and backup pistons 618 that are arranged on opposite sides of the elongated body 608. The extendable probe 616 may be configured to selectively seal off or isolate selected portions of the wall 603 of the wellbore 602 to fluidly couple to the adjacent formation 620 and/or to draw fluid samples from the formation 620. The probe 616 may include a single inlet or multiple inlets designed for guarded or focused sampling. The reservoir fluid may be expelled to the wellbore through a port in the body 608, or the reservoir fluid may be sent to one or more fluid sampling modules 622 and 624. The fluid sampling modules 622 and 624 may include sample chambers that store the reservoir fluid. In addition, the electronics and processing system 606 and/or a downhole control system may be configured to control the extendable probe assembly 616 and/or the drawing of a fluid sample from the formation 620.

In yet another implementation, FIG. 7 illustrates a downhole tool 700 in accordance with implementations of various technologies and techniques described herein. In one implementation, the downhole tool 700 may be a drilling tool, such as the downhole tool 502 described above with respect to FIG. 5. In another implementation, the downhole tool 700 may be a wireline tool, such as the downhole tool 600 described above with respect to FIG. 6. In yet another implementation, the downhole tool 700 may be conveyed on wired drill pipe, a combination of wired drill pipe and wireline, and/or other suitable types of conveyance.

As shown in FIG. 7, the downhole tool 700 may include a fluid communication module 704 that has a probe 702 for directing reservoir fluid into the downhole tool 700. The fluid communication module 704 may be similar to the fluid communication modules 530 and 614, described above with respect to FIGS. 5 and 6, respectively. As shown in FIGS. 5-7, the probe 702 may include an extendable probe that moves out from the body of the downhole tool to engage the formation. However, in another implementation, the probe 702 may include an expandable packer with a drain that engages the formation to draw reservoir fluid into the downhole tool. Further, in yet another implementation, two or more inflatable packers may be disposed on opposite sides of an inlet in the body of the downhole tool that draws reservoir fluid into the downhole tool. Moreover, more than one probe 702 may be employed to draw reservoir fluid into the downhole tool.

The fluid communication module 704 may include a probe flow line 706 that may direct the fluid to a primary flow line 708 that extends through the downhole tool 700. The fluid communication module 704 may also include a pump 710 and pressure gauges 712 and 714 that may be employed to conduct formation pressure tests. An equalization valve 716 may be opened to expose the flow line 706 to the pressure in the wellbore, which in turn may equalize the pressure within the downhole tool 700. Further, an isolation valve 718 may be closed to isolate the reservoir fluid within the flow line 706, and may be opened to direct the reservoir fluid from the probe flow line 706 to the primary flow line 708.

The primary flow line 708 may direct the reservoir fluid through the downhole tool to a fluid analysis module 720 that includes a fluid analyzer 722 that can be employed to provide DFA measurements. For example, the fluid analyzer 722 may include an optical spectrometer and/or a gas analyzer designed to measure properties such as, optical density, fluid fluorescence, fluid composition, the GOR, and/or the like. In particular, the spectrometer may employ one or more optical filters to identify the color (i.e., the optical density) of the reservoir fluid. Such color measurements may be used for fluid identification, determination of asphaltene content, and/or pH measurement. The reservoir fluids may exhibit different colors because they have varying amounts of aromatics, resins, and asphaltenes, each of which absorb light in the visible and near-infrared ("NIR") spectra. Heavy oils may have higher concentrations of aromatics, resins, and asphaltenes, which give them dark colors. Light oils and condensate, on the other hand, may have lighter, yellowish or bluish colors because they have lower concentrations of aromatics, resins, and asphaltenes.

One or more additional measurement devices, such as temperature sensors, pressure sensors, viscosity sensors, density sensors, resistivity sensors, chemical sensors (e.g., for measuring pH or $H_2S$ levels), and gas chromatographs may also be included within the fluid analyzer 722. In one implementation, the fluid analyzer 722 may measure absorption spectra and translate such measurements into concentrations of several alkane components and groups in the fluid sample. For example, the fluid analyzer 722 may determine the concentrations (e.g., weight percentages) of carbon dioxide ($CO_2$), methane ($CH_4$), ethane ($C_2H_6$), the $C_3$-$C_5$ alkane group, and the lump of hexane and heavier alkane components ($C_{6+}$).

The fluid analysis module 720 may also include a controller 726, such as a microprocessor or control circuitry, designed to calculate certain fluid properties based on the sensor measurements. For example, the controller 726 may calculate the GOR. Further, the controller 726 may govern sampling operations based on the fluid measurements or properties. Moreover, the controller 726 may be disposed within another module of the downhole tool 700.

The downhole tool 700 may also include a pump out module 728 that has a pump 730 designed to provide motive force to direct the fluid through the downhole tool 700. In one implementation, the pump 730 may be a hydraulic displacement unit that receives fluid into alternating pump chambers. A valve block 732 may direct the fluid into and out of the alternating pump chambers. The valve block 732 also may direct the fluid exiting the pump 730 through the remainder of the primary flow line 708 (e.g., towards the sample module 736) or may divert the fluid to the wellbore through an exit flow line 734.

The downhole tool 700 may also include one or more sample modules 736 designed to store samples of the reservoir fluid within a sample chamber 738. As shown in FIG. 7, a single sample chamber 738 may be included within the sample module 736. However, in another implementation, multiple sample chambers may be included within the sample module 736 to provide for storage of multiple reservoir fluid samples. In yet another implementation, multiple sample modules 736 may be included within the downhole tool. Moreover, other types of sample chambers, such as single phase sample bottles, among others, may be employed in the sample module 736.

The sample module 736 may include a valve 740 that may be actuated to divert the reservoir fluid into the sample chamber 738. The sample chamber 738 may include a floating piston 742 that divides the sample chamber into two volumes 750 and 751. As the reservoir fluid flows through the primary flow line 708, the valve 740 may be actuated to divert the reservoir fluid into the volume 750. In one implementation, the pump 730 may provide the motive force to direct the fluid through the primary flow line 708 and into the sample chamber 738. The reservoir fluid may be stored within the volume 751. In another implementation, and as mentioned above, the reservoir fluid may be brought to the surface for further analysis. The sample module 736 also may include a valve 748 that can be opened to expose the volume 750 of the sample chamber 738 to the annular pressure. In yet another implementation, the valve 748 may be opened to allow buffer fluid to exit the volume 750 to the wellbore, which may provide backpressure during filling of the volume 751 that receives reservoir fluid. The volume 750 may be filled with a low pressure gas that provides backpressure during filling of the volume 751.

The downhole tools described above with respect to FIGS. 5-7 may also be referred to as formation testers. Besides the implementations disclosed in FIGS. 5-7, other implementations of well site systems employing DFA systems and techniques known to those skilled in the art may be used. One example of a downhole tool which may be used to employ such systems and techniques may include the Modular Formation Dynamics Tester (MDT®), which is a registered trademark of Schlumberger Technology Corporation. Further, examples of a fluid communication module and/or fluid analysis module as described with respect to FIGS. 5-7 may include the Composition Fluid Analyzer (CFA®), Live Fluid Analyzer (LFA®), or the In Situ Fluid Analyzer (IFA®), which are registered trademarks of Schlumberger Technology Corporation.

In one implementation, a computing system associated with the fluid communication module and/or fluid analysis module as described above, such as the controller 726, may be used to determine the properties of the reservoir fluid (e.g., optical density, GOR, etc.) in substantially real time. In another implementation, the computing system associated with the fluid communication module and/or fluid analysis module may operate in conjunction with a surface computing system, such as the electronics and processing system 606 described above.

Further, other well logging instruments may be used in conjunction with the downhole tools described above, including those used to measure electrical resistivity, compressional and shear acoustic velocity, naturally occurring gamma radiation, gamma-gamma Compton scatter formation density, formation neutron hydrogen index (related to the fluid filled fractional volume of pore space of the rock formations), and/or nuclear magnetic resonance transverse and longitudinal relaxation time distribution and diffusion constant. In such an implementation, the well logging instruments, such as those that measure gamma radiation, may assist in identifying potential areas of interest in the subterranean formation. In particular, measurement stations may be assigned to these potential areas for the withdrawal of reservoir fluid samples.

Further Analysis

After conducting the DFA of one or more reservoir fluid samples, the results of the DFA may be related to one or more equation of state (EOS) models of the thermodynamic behavior of the reservoir fluid in order to characterize the reservoir fluid at different locations within the reservoir. In particular, computer-based modeling and simulation techniques may use the EOS models to estimate the fluid properties and/or behavior of reservoir fluid within the reservoir. In one implementation, a surface computing system, such as the electronics and processing system 606 described above, may estimate the fluid properties and/or fluid behavior using the EOS models. In such an implementation, the surface computing system may perform the estimations based on received DFA data. The received DFA data may include measurements and/or calculations for optical density, fluid fluorescence, fluid composition, the GOR, pressure, volume, temperature, fluid density, fluid viscosity, and/or the like. The surface computing system may receive the DFA data from a computing system associated with the fluid communication module and/or fluid analysis module as described above, such as the controller 726 of FIG. 7.

The EOS models may represent the phase behavior of the reservoir fluid, and can be used to compute fluid properties, such as: GOR, condensate-gas ratio (CGR), density of each phase, volumetric factors and compressibility, heat capacity and saturation pressure (bubble or dew point). Thus, the EOS models can be solved to obtain saturation pressure at a given temperature. Moreover, GOR, CGR, phase densities, and volumetric factors may be byproducts of the EOS models. Transport properties, such as heat capacity or viscosity, can be derived from properties obtained from the EOS models, such as fluid composition.

Furthermore, the EOS models can be extended with other reservoir evaluation techniques for compositional simulation of flow and production behavior of the petroleum fluid of the reservoir, as is known in the art. For example, compositional simulations can be used to study: (1) depletion of a volatile oil or gas condensate reservoir where phase compositions and properties vary significantly with pressure below bubble or dew point pressures, (2) injection of non-equilibrium gas (dry or enriched) into a black oil reservoir to mobilize oil by vaporization into a more mobile gas phase or by condensation through an outright (single-contact) or dynamic (multiple-contact) miscibility, and (3) injection of $CO_2$ into an oil reservoir to mobilize oil by miscible displacement and by oil viscosity reduction and oil swelling.

The EOS models may include a set of equations that represent the phase behavior of the compositional components of the reservoir fluid. Such equations can take many forms. For example, they can be any one of many cubic EOS as is known in the art. Such cubic EOS may include van der Waals EOS (1873), Redlich-Kwong EOS (1949), Soave-Redlich Kwong EOS (1972), Peng-Robinson EOS (1976), Stryjek-Vera-Peng-Robinson EOS (1986) and Patel-Teja EOS (1982). Volume shift parameters can be employed as part of the cubic EOS in order to improve liquid density predictions as is known in the art. Mixing rules (such as van ser Waals mixing rule) can also be employed as part of the cubic EOS. A SAFT-type EOS can also be used as is known in the art. In these equations, the deviation from the ideal gas law may be accounted for by introducing (1) a finite (non-zero) molecular volume and (2) some molecular interaction. These parameters can then be related to the constants of the different chemical components.

Further, an EOS that describes the distribution of a solid fraction of the reservoir fluid (e.g., asphaltenes, resins, and/or the like), may be used. In one implementation, such EOS may include the Flory-Huggins-Zuo EOS. The above described equations of state may be used with the Yen-Mullins model, which describes the physical nature of asphaltenes in crude. Such a combination may be used to provide a description of a baseline thermodynamic equilibrium state of a hydrocarbon column that includes gas, liquid, and solid petroleum components. Further, the EOS may include equilibrium equations described in U.S. Pat. No. 7,822,554 by Zuo et al., assigned to Schlumberger Technology Corporation, which is herein incorporated by reference in its entirety.

In one implementation, an EOS model may predict compositional gradients with depth that take into account the impacts of gravitational forces, chemical forces, temperature gradient, and/or the like. To calculate compositional gradients with depth in a hydrocarbon reservoir, it may be assumed that the reservoir fluids are connected (i.e., there is a lack of compartmentalization) and in thermodynamic equilibrium. In particular, it may be assumed that the reservoir fluids are in thermodynamic equilibrium with substantially little adsorption phenomena, addition of matter to the reservoir, pressure gradients other than gravity, heat fluxes across system boundaries, and/or chemical reactions in the reservoir.

With respect to optical density measurements obtained via a downhole tool as described above, errors may arise from both instrumentation and environmental conditions during the measurement. The total error for the optical density measurements ($\delta_{total}$) may consist of the measurement error in the tool itself ($\delta_{tool}$), a depth error ($\delta_{depth}$), and a fluid contamination error ($\delta_{cont}$).

With respect to the fluid contamination error, estimates of oil-based mud (OBM) contamination from the optical density data may be performed using an algorithm which applies the time-varying color and methane signals obtained while pumping reservoir fluids during sampling to a predetermined function. Such an algorithm may include the Oil-Based Mud Contamination Monitoring algorithm (OCM®), which is a registered trademark of Schlumberger Technology Corporation.

Contamination of the reservoir fluid samples may lead to an underestimation of saturation pressure, GOR, and optical density, as OBM filtrate may be colorless and may dilute the asphaltene molecules in the crude oil. Methods used to estimate the OBM contamination level of a reservoir fluid sample in the laboratory include the skimming method and subtraction method, as is known to those skilled in the art. Errors which may arise from the use of these methods may be more prevalent in fluid samples indicating relatively low or high contamination levels. For instance, a relatively pure sample from a long-time producing well could, in actuality, show some level of contamination in the laboratory. In addition, a sample that indicates a 90% contamination by volume could, in actuality, be estimated in the lab as having 70% contamination by volume.

Accordingly, the measured data may be corrected for contamination by OBM filtrates through the use of a formula. In particular, the formula may use a concentration of the OBM filtrate, $V_{filtrate}$, i.e. the volume fraction of OBM filtrate, which may be determined in the laboratory. The volume fraction of the contaminant, $V_{filtrate}$, may be related to the mass fraction of filtrate, $W_{filtrate}$, as $$W_{filtrate} = \frac{\text{mass filtrate}}{\text{mass oil + filtrate}} = V_{filtrate}\frac{\text{density filtrate}}{\text{density oil + filtrate}}.$$

In another implementation, the formula may use an estimated contamination obtained via the DFA. The following expression may illustrate the relationship between the measured value of optical density ($OD_{measured}$) and the optical density of native reservoir fluid disposed in the reservoir ($OD_{oil}$):

$$OD_{measured} = V_{filtrate} * OD_{filtrate} + (1 - V_{filtrate})OD_{oil} \quad \text{Equation 1}$$

The optical density of the filtrate ($OD_{filtrate}$) may be assumed to be zero. Accordingly, the expression above may be rewritten as:

$$OD_{measured} = (1 - V_{filtrate})OD_{oil} \quad \text{Equation 2}$$

Assigning an error to the contamination estimate may not be possible with the available data. However, a simple estimate using Equation 2 may indicate that a 1% error in the contamination estimate would translate to a 0.01 error in $\delta_{cont}$.

In addition, in obtaining the optical density measurements, a wireline depth measurement may be made at the surface using a wheel spooler, such as the Integrated Dual Wheel (IDW®) spooler, which is a registered trademark of Schlumberger Technology Corporation. Such a wheel spooler may have an accuracy of approximately plus or minus 2 feet (ft) per 10,000 ft. The wireline depth measurements may be more accurate in low-deviation wells. In particular, in deviated wells, the depth from wireline logs may be biased towards higher values.

In order to estimate the error in the optical density measurements caused by depth uncertainty ($\delta_{depth}$), an EOS equation may be used to estimate the variation in optical density for a given fluid system. In one implementation, the EOS equation may include the Flory-Huggins-Zuo EOS. In one implementation, a 10 ft error in depth may result in a 1% error value for $\delta_{depth}$.

In addition, errors in optical density measurements may arise from the use of a downhole tool and/or its associated components, such as the fluid communication module and/or fluid analysis modules as described with respect to FIGS. 5-7. In one implementation, an IFA spectrometer may have a one-sigma uncertainty ($\delta_{tool}$) of 0.01 and wavelength accuracy of plus or minus 1 nanometer (nm). In practice, however, the IFA spectrometer may have an accuracy ($\delta_{tool}$) of 0.005.

Adding the contribution of the three main sources of error in this procedure, $\delta_{depth}$, $\delta_{cont}$, and $\delta_{tool}$ may provide a total optical density measurement error ($\delta_{total}$). Accordingly, for an IFA spectrometer, and based on the above, the total optical density measurement error (for depth in units of feet) may be:

$$\delta_{total} = 0.005\left(\frac{\text{Measured Depth}}{10000}\right) + 0.5V_{filtrate} + \delta_{tool} \quad \text{Equation 3}$$

In one implementation, the total optical density measurement error may be computed using a surface computing system, such as the electronics and processing system 606 described above.

Mud Gas Logging

As mentioned above, mud gas logging (MGL) techniques may be used in conjunction with DFA to identify variations in fluid properties of the reservoir, which may in turn be used to detect compartmentalization and/or non-equilibrium hydrocarbon distribution in the reservoir. MGL may provide a continuous surface measurement, while drilling, of hydrocarbons in gas extracted from the drilling mud. In particular, it may provide a quantitative analysis of $C_1$ (methane) to $C_5$ (pentanes) and a qualitative analysis of $C_6$ to $C_8$ and light aromatics (e.g., benzene and toluene). In one implementation, MGL may include isotope logging. In particular, isotope logging may provide a continuous surface measurement during the drilling operations of the relative concentration of stable carbon isotopes of hydrocarbons in gas extracted from the drilling mud. The isotope logging may be performed during drilling operations or may be acquired after drilling, such as in a laboratory setting.

In particular, and as further described below, MGL may provide, in real time or substantially real time, geochemical information used to identify fluid generation pathways, biodegradation, reservoir tops, fault and cap rock sealing properties, reservoir compartmentalization, fluid associations, and/or the like for the reservoir of interest. In such an implementation, the MGL may be used to identify whether an origin of the extracted gas can be considered biogenic or thermogenic.

In one implementation, MGL techniques may include gas phase chromatography, the use of laser-based analyzers (e.g., infrared-based analyzers), and/or the like. In particular, gas phase chromatography may be used for the separation and quantification of mud gas components. MGL using gas phase chromatography may allow monitoring of the drilling process for safety and performing a pre-evaluation of the type of fluids encountered in drilled formations. In such an implementation, a gas extractor (sometimes referred to as a degasser) may be used to extract gases from the drilling mud, such as the Geoservices Extractor of U.S. Pat. No. 7,032,444, which is incorporated herein by reference. After extraction, the mud gases may be transported and analyzed directly in a mud logging unit. A qualitative and/or quantitative continuous compositional or isotopic analysis may be performed on fluids involved in MGL, which may be used to characterize the hydrocarbons present in the drilled reservoir versus depth. The more measurements performed, the better the level of resolution of gas events described by the MGL services.

In another implementation, MGL may include isotope logging, such as a continuous real time (CRT) logging of isotopic compositions of methane, which may be expressed as δ (e.g., $\delta^{13}C$), extracted from drilling mud during drilling operations. These techniques are further described in more detail in PCT Patent Application No. WO2008/017949 and PCT Patent Application No. WO2009/037517, which are incorporated herein by reference. Isotopic compositions of methane ($\delta^{13}C$, $\delta^{2}H$) and/or other gases may also be used. These techniques are further described in more detail in Bernard, et al., 1978, "Light hydrocarbons in recent Texas continental shelf and slope sediments," Journal of Geophysical Research 83, pp. 4053-4061; Schoell M, 1983, "Genetic characterization of natural gases," American Association of Petroleum Geologists Bulletin 67, pp. 2225-2238; Berner, et al., 1988, "Maturity related mixing model for methane, ethane and propane, based on carbon isotopes," Advances in Organic Geochemistry 13, pp. 67-72; and Whiticar M., 1996, "Carbon and hydrogen isotope systematics of bacterial formation and oxidation of methane," Chemical Geology 161, pp. 291-314.

In particular, MGL may include the analysis of gas extracted from drilling mud coming out (referred to as gas OUT) of the wellbore and gas extracted from drilling mud injected into the wellbore (referred to as gas IN). Synchronization of these gases and subtraction of the gas IN may provide quantitative formation gas compositions of methane, ethane, propane, iso-butane, n-butane, iso-pentane, and/or n-pentane. These techniques are further described in more detail in U.S. Pat. No. 7,032,444, U.S. Patent Application Publication No. 2014/0067307, and U.S. Patent Application Publication No. 2011/0303463, which are incorporated herein by reference.

Figure 8:
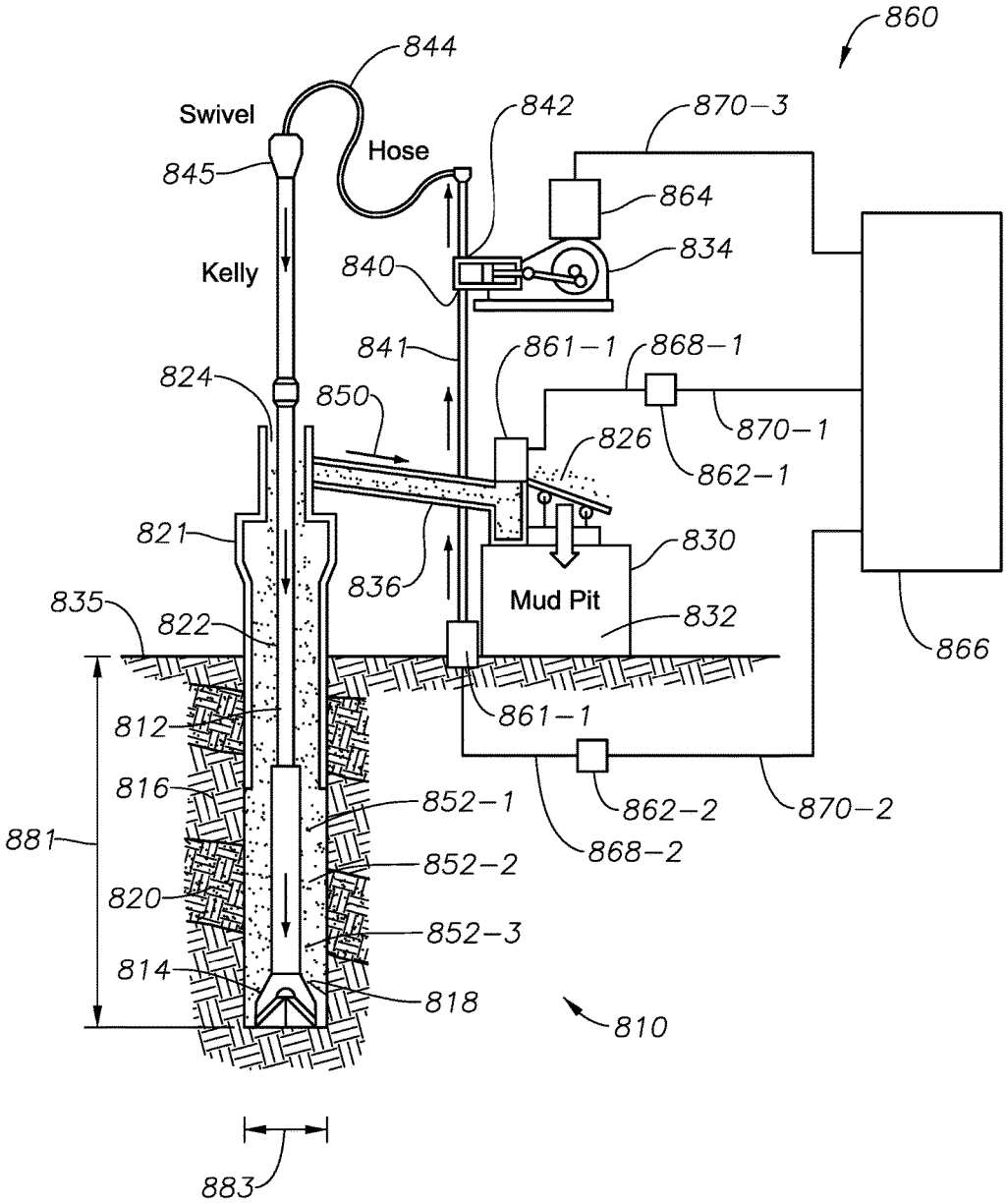
FIG. 8 illustrates a well site system in accordance with implementations of various technologies and techniques described herein.

Various implementations of well site systems described herein may employ MGL systems and techniques. In one implementation, FIG. 8 illustrates a well site system 810 in accordance with implementations of various technologies and techniques described herein. The well site system 810 may include a drill string 812 connected to a drilling tool 814 being advanced through a geologic formation 816 to form a wellbore 818. The drilling tool 814 can be conveyed among one or more (or itself may be) a measurement-while-drilling (MWD) drilling tool, a logging-while-drilling (LWD) drilling tool, and/or other drilling tools that are known to those skilled in the art. The drilling tool 814 may be attached to the drill string 812 and may be driven by a rig (not shown) to form the wellbore 818, thereby creating an annulus 820 between an exterior surface 822 of the drill string 812 and the geologic formation 816. The wellbore 818 may be lined with a casing 21 provided with an entrance 24 through which the drill string 12 passes. In one implementation, the well site system 810 may be incorporated into one of the well site systems described above, such as those discussed above with respect to FIGS. 5-7. In another implementation, the drill string 812 and drilling tool 814 may be similar to those discussed above with respect to FIGS. 5-7.

The well site system 810 may also be provided with one or more shale shakers 826 positioned adjacent to one or more containers 830. The containers 832 may contain drilling mud 832. The well site system 810 may also be provided with one or more mud pumps 834 circulating the drilling mud 832 through the drill string 812, the drilling tool 814, and the annulus 820 while the drilling tool 814 is being advanced into the geologic formation 816. The drilling mud 832 may serve a variety of functions, including, but not limited to, lubricating the drilling tool 814 and conveying the cuttings to a surface 835 of the geologic formation 816. The container 830 may be connected to the entrance 824 of the wellbore 818 via a first flow line 836.

The shale shaker 826 may be implemented in a variety of manners. In particular, the shale shaker 826 may serve to remove cuttings from the drilling mud 832. In one implementation, the shale shaker 826 may include a vibrating screen with openings through which the drilling mud 832, but not the cuttings, may pass. After passing through the shale shaker 826, the drilling mud 832 may pass into the container 830. The container 830 can be constructed in a variety of forms and may be a structure referred to in the art as a mud pit.

The mud pump 834 may have an inlet 840 receiving drilling mud 832 from the container 830 via a second flow line 841, and may also have an outlet 842 injecting drilling mud into the drill string 812 through a mud injection line 844. In one implementation, the mud injection line 844 may be connected to the drill string 812 via a swivel 845 to permit the drill string 812 to be rotated via a kelly (not shown) relative to the mud injection line 844, thereby aiding the drilling tool 814 in forming the wellbore 818. The mud pump 834 may circulate drilling mud 832 through a flow path 850 (shown by way of arrows in FIG. 8) formed sequentially by the mud injection line 844, an inner bore (not shown) of the swivel 845, an inner bore (not shown) of the drill string 812, an inner bore (not shown) of the drilling tool 814, the annulus 820 of the wellbore 818, the first flow line 836, the container 830, and the second flow line 841.

To determine isotopic characteristics of gas entering the drilling mud 832 at particular locations 852-1, 852-2, 852-3, etc. of the wellbore 818, the well site system 810 may use a mud gas analyzer 860. In one implementation, the mud gas analyzer 860 may be positioned above the surface 835 of the geologic formation 816.

In another implementation, the mud gas analyzer 860 may be provided with at least one degasser 861 (i.e., a gas extractor), at least one gas analyzer 862, an optional at least one flow meter 864, and a computer system 866. Further, the mud gas analyzer 860 may also include two degassers 861-1 and 861-2 and two gas analyzers 862-1 and 862-2. In a further implementation, the gas analyzer 862-1 may be positioned adjacent to and/or within the first flow line 836 between the entrance 824 and the shale shaker 826. Additionally, the gas analyzer 862-2 may be positioned adjacent to and/or within the second flow line 841 and/or the mud injection line 844. The degasser 861-1 may extract gas from the drilling mud 832 and direct the gas to the gas analyzer 862-1 via a third flow line 868-1. The degasser 861-2 may extract gas from the drilling mud 832, and may direct the gas analyzer 862-2 via a fourth flow line 868-2.

The at least one degasser 861 can be implemented as any device adapted to extract gas from the drilling mud 832 and direct the gas to the at least one mud gas analyzer 860. For example, the at least one degasser 861 can be implemented in a manner taught in U.S. Pat. No. 7,032,444, which is incorporated herein by reference. In other implementations, other types of devices and/or processes can be used, such as selective membranes and sonication, to release gas from the drilling fluid 832.

In one implementation, two degassers 861-1 and 861-2 (for mud IN and mud OUT, as described below) may be used to maintain constant mud flow and temperature, including constant and equal temperatures of the degassers. The degassers 861-1 and 861-2 may also be used to produce a direct quantitative comparison of gas IN and gas OUT. Subsequently, extracted gas may travel towards the analyzers 862-1 and 862-2 via the third and fourth flow lines 868-1 and 868-2 gas line. A substantially constant gas flow within the third and fourth flow lines 868-1 and 868-2 may be produced using a gas flow restrictor.

The gas analyzers 862-1 and 862-2 may interact with the mud gas passing through the third and fourth flow lines 868-1 and 868-2. The gas analyzers 862-1 and 862-2 may also generate a sequence of signals indicative of the gas molecular compositions (methane, ethane, propane, and/or the like) and ratios of isotopes of these gas species (e.g. $^{13}C/^{12}C$ of methane) within the drilling mud 832.

As noted earlier, such qualitative and/or quantitative compositional or isotopic analysis may be performed in a laboratory, such as in an on-site or off-site setting using spot mud gas samples. Isotope analyses of spot samples (e.g., using isotubes, vacutainers, gas bags, and/or the like) can contribute to the depth of analysis (i.e., $\delta^{13}C$ and $\delta^{2}H$ ratios of C1 to C5s) of fluid typing and subsurface processes involved. The value of spot sample interpretation, however, may be enhanced by placement in the context by continuous isotoπ$^{e}$ logs, as logs provide spatial observations (e.g., gradients, thin beds, discontinuities, and/or the like).

The mud gas analyzer 860 may also include a first communication link 870-1 connecting the gas analyzer 862-1 to the computer system 866, a second communication link 870-2 connecting the gas analyzer 862-2 to the computer system 866, and a third communication link 870-3 connecting the flow meter 864 to the computer system 866. The first, second and third communication links 870-1, 870-2, and 870-3 may be implemented via wired or wireless devices, such as a cable or a wireless transceiver. In particular, the first and second communication links 870-1 and 870-2 may establish electrical and/or optical communications between the gas analyzers 862-1 and 862-2 and the computer system 866. The third communication link 870-3 may establish electrical and/or optical communications between the flow meter 864 and the computer system 866. In one implementation, the gas analyzer 862-1, the gas analyzer 862-2, the flow meter 864, the computer system 866, the first communication link 870-1, the second communication link 870-2, and the third communication link 870-3 may be located above the surface 835 of the geologic formation 816.

The gas analyzer 862-1 and/or the gas analyzer 862-2 may be adapted to interact with the drilling mud 832 as the drilling mud 832 passes through the flow path 850, where the flow path 850 may be formed at least partially by the drill string 812 within the wellbore 18 and the annulus 820. In one implementation, the gas analyzer 862-1 may interact with the drilling mud 832 passing from the entrance 824 to the shale shaker 826. This drilling mud 832 may be referred to herein as drilling mud OUT. The drilling mud OUT may contain non-liberated residual gas that is enriched in heavier isotopes. In another implementation, the gas analyzer 862-2 may interact with the gas from the drilling mud 832 passing from the container 830 to the drill string 812. This drilling mud 832 may be referred to herein as drilling mud IN. The drilling mud IN may be subjected to mud degassing, as well as isotopic fractionation, and thus may have an isotopic composition that is different from the drilling mud OUT.

The at least one gas analyzer 862, such as the gas analyzer 862-1 and/or the gas analyzer 862-2, can be implemented with any type of device and/or circuitry (or devices working together) adapted to determine and generate a sequence of first signals indicative of ratios of isotopes of one or more molecules of gas within the drilling mud 832 at separate and/or distinct instances of time. In particular, any type of gas analyzing device that can measure isotopic concentrations used to obtain a ratio of the isotopic measurements can be used.

For example, the at least one gas analyzer 862 can be implemented as gas chromatograph-isotope ratio mass spectrometer (GC-IRMS), a spectrophotometer or photoacoustic detector working on the TDLAS (Tunable Diode Laser Absorption Spectroscopy) principle or the CRDS (Cavity Ring Down Spectroscopy), and/or any other technology able to provide relative concentration of isotopes of a gas species (e.g., $^{13}C$ and $^{12}C$ in $CH_4$, or $^{18}O$ and $^{16}O$ in $CO_2$, etc.). Further, although two gas analyzers 862-1 and 862-2 are shown and described herein, in other implementations, the mud gas analyzer 860 may include one gas analyzer 862 or more than two gas analyzers 862. For example, in other implementations, the mud gas analyzer 860 may include 8 or more gas analyzers 862. Additionally, the mud gas analyzer 860 may include the gas analyzer 862-1 or 862-2 being used to emulate two or more gas analyzers by using a valve in combination with the gas analyzer 862. Such an implementation can be used to direct more than one flow line to the gas analyzer 862.

The at least one flow meter 864 may include devices and/or circuitry to determine a rate of flow of the drilling mud 832. The flow meter 864 may also be used to generate a sequence of signals as the drilling mud 832 is circulated through the flow path 850 at separate and/or distinct instances of time. As discussed below, the sequence of signals and/or a known flow rate of the drilling mud can be utilized by the computer system 866 to determine a delay time. This delay time can be used to synchronize the reading of the drilling mud IN with the reading of the drilling mud OUT. Such synchronization may be used to perform the depth projection, so that the isotopic characteristics of the geologic formation 816 can be determined.

Further, the flow meter 864 may be implemented as a device that determines the flow rate indirectly by counting rotations of a spindle of the mud pump 834 as the mud pump 834 pumps a known amount of drilling mud 832 with each rotation. However, it should be understood that the flow meter 864 can be implemented in other manners. For example, the flow meter 864 can be implemented in a manner to apply a medium, such as magnetic flux lines, into the drilling mud 832 to directly measure the flow rate of the drilling mud 832. In this instance, the flow meter 864 may have a transmitter/receiver pair to generate the medium and to receive the medium after the medium has interacted with the drilling mud 832. Further, in other implementations, the mud gas analyzer 860 may include more than one flow meter 864. The sequence of signals can be provided in electrical and/or optical formats, for example.

To perform analysis of the measured values from the MGL, such as those which represent the formation gas isotopic composition, the computer system 866 may include a processor that may be adapted to execute logic to cause the processor to access information indicative of a geometry of the wellbore 818 and a tool string, where the tool string may include the drill string 812 and the drilling tool 814. In one implementation, the computer system 866 may receive the sequence of signals and calculate and log isotopic characteristics of gas entering the drilling mud 832 at particular locations (e.g., location 852-1, location 852-2, and location 852-3) of the geologic formation 816.

The geometry of the wellbore 818 may include a variety of factors, such as a length 881 of the wellbore 818, a diameter 883 of the wellbore 818 and geometry and/or volumetrics of the tool string. The geometry of the tool string may include a diameter and combined length of the drill string 812 and the drilling tool 814, as well as depth of the bit and structural configuration of the drilling tool 814 (e.g., including elements of the bottom hole assembly). Information regarding the geometry of the wellbore 818 and the geometry of the tool string can be entered into the computer system 866 by an operator, such as when a change to the tool string is being made, for example. The locations 852-1, 852-2 and 852-3 of the geologic formation 816 may be described using any suitable geographic coordinate system, including at least one number representing vertical position and two or three numbers representing horizontal position. For example, a suitable geographic coordinate system may use latitude and longitude to identify horizontal position, and may use elevation to identify vertical position.

Analysis of MGL and DFA

As noted above, integration of DFA and MGL may be used to provide data that can be used to accurately detect compartmentalization and/or non-equilibrium hydrocarbon distribution in the reservoir of interest. In particular, and as described with respect to FIGS. 5-8, DFA and MGL may provide hydrocarbon and non-hydrocarbon ($CO_2$) composition information to generate one or more models of reservoir fluid in the reservoir of interest.

For example, new measurements performed using the DFA and the MGL at different spatial locations in the reservoir may be contrasted with a prediction model derived from the new measurements. In one implementation, agreement between the new measurements and the model may imply connectivity between the spatial locations, provided that the fluid samples obtained from the spatial locations are in thermodynamic equilibrium and that isotopic logging measurements are consistent at the respective spatial locations.

On the other hand, disagreement between the new measurements and the model may be further investigated to identify possible causes of instability that preclude thermodynamic equilibrium. As noted above, such causes may include geologic events that may alter the reservoir structure after the primary charge, thermally mature fluids that may arrive to the reservoir, hydrocarbons that may escape via flow channels or a compromised cap seal, ongoing and/or prior biodegradation at sufficiently low temperature and mixing with biogenic methane, biogenic methane arriving at the reservoir, water washing, and/or the like. In addition, analyzed data from the DFA and the MGL could be used to ascertain information relating to migration of the reservoir fluids, origin of the fluids, composition of the fluids, and/or the like.

Various implementations of well site systems described herein may be used to employ an integration of DFA and MGL, including a well site system that combines one or more implementations discussed above with respect to FIGS. 5-8.

Figure 9:
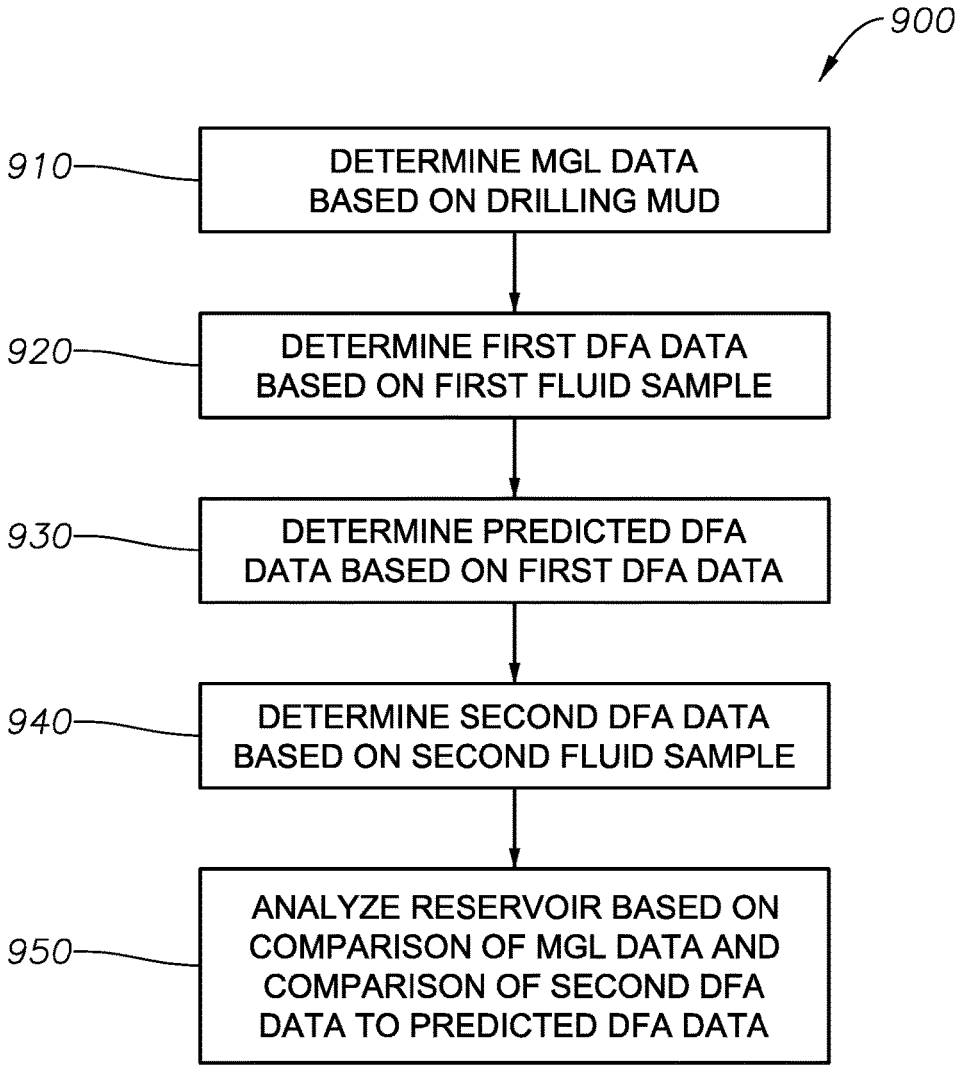
FIG. 9 illustrates a flow diagram of a method for analyzing a reservoir of interest in accordance with implementations of various techniques described herein.

FIG. 9 illustrates a flow diagram of a method 900 for analyzing a reservoir of interest in accordance with implementations of various techniques described herein. In one implementation, method 900 may be performed by one or more computer applications, where the computer applications may implement one or more of the electronics and processing system 606, controller 726 of the fluid analysis module 720, and/or the computer system 866 described above. It should be understood that while method 900 indicates a particular order of execution of operations, in some implementations, certain portions of the operations might be executed in a different order. Further, in some implementations, additional operations or blocks may be added to the method. Likewise, some operations or blocks may be omitted.

At block 910, MGL data may be determined based on drilling mud associated with one or more wellbores traversing the reservoir of interest. In one implementation, as described above, MGL data may include a quantitative composition of hydrocarbons in gas extracted from the drilling mud, such as a composition of $C_1$ (methane) to $C_5$ (pentanes). In another implementation, for isotope logging, the MGL data may include the relative concentration of stable carbon isotopes of hydrocarbons in gas extracted from the drilling mud. In such an implementation, a computer application, such as the computer system 866, may receive data indicative of the gas molecular compositions (methane, ethane, propane, etc.) and ratios of isotopes of a gas species (e.g. $^{13}C/^{12}C$ of methane) within the drilling mud. The computer application may then calculate and log the isotopic characteristics of gas entering the drilling mud, where the logged characteristics represent the determined MGL data.

As noted above, MGL may provide a continuous surface measurement during the drilling of a wellbore. Thus, in one implementation, for a single wellbore, MGL data may be determined for multiple depth locations within the wellbore. In another implementation, for multiple wellbores traversing the reservoir, the MGL data may be determined for multiple depth intervals in each wellbore.

At block 920, first DFA data may be determined based on a first fluid sample obtained at a first measurement station of a wellbore. In one implementation, the first fluid sample may be obtained using a downhole tool, such as those described above with respect to FIGS. 5-7. Further, as described above with respect to FIGS. 5-7, a computing application associated with a fluid communication module and/or fluid analysis module, such as the controller 726, may be used to determine the first DFA data in substantially real time. In another implementation, the computing application associated with the fluid communication module and/or fluid analysis module may operate in conjunction with a surface computing application, such as the electronics and processing system 606, to determine the first DFA data.

In addition, as described above with respect to FIGS. 5-7, the first DFA data may include one or more measurements of optical density, fluid fluorescence, fluid composition, the GOR, temperature, pressure, viscosity, density, resistivity, pH or $H_2S$ levels, concentrations of several alkane components and groups in the first fluid sample (e.g., fractional amounts of $C_1$, $C_2$, $C_3$-$C_5$, $C_{6+}$, $CO_2$, $H_2O$, and the like), and/or the like. Moreover, as mentioned above, the first DFA data may be determined during drilling or thereafter.

At block 930, predicted DFA data may be determined based on the first DFA data. In particular, one or more EOS models of the thermodynamic behavior of the reservoir fluid may be used to characterize the reservoir fluid at different locations within the reservoir. In one implementation, a surface computing system, such as the electronics and processing system 606, may estimate the fluid properties and/or fluid behavior using the EOS models. In such an implementation, the surface computing system may perform the estimations based on the first DFA data. In another implementation, the surface computing system may perform the estimations based on DFA data from multiple measurement stations. In yet another implementation, the surface computing system may perform the estimations based on a fluid composition generated based on the MGL data and the first DFA data.

One or more EOS models as described above may be used to estimate fluid properties for the wellbore of block 920, including fluid properties such as: GOR, condensate-gas ratio (CGR), density of each phase, volumetric factors and compressibility, heat capacity, saturation pressure (i.e., bubble or dew point), optical density, the distribution of a solid fraction of the reservoir fluid (e.g., asphaltenes, resins, and/or the like), viscosity, and/or the like. In one implementation, the EOS models may estimate the fluid properties and/or fluid behavior as a function of depth, such that the fluid properties and/or fluid behavior are predicted for one or more additional measurement stations in the wellbore of block 920.

At block 940, second DFA data may be determined based on a second fluid sample obtained at a second measurement station. The second fluid sample may be obtained in a similar manner as the first fluid sample, and the second DFA data may be determined in a similar manner as the first DFA data.

Further, the second DFA data may also include one or more measurements of optical density, fluid fluorescence, fluid composition, the GOR, temperature, pressure, viscosity, density, resistivity, pH or $H_2S$ levels, concentrations of several alkane components and groups in the first fluid sample (e.g., fractional amounts of $C_1$, $C_2$, $C_3$-$C_5$, $C_{6+}$, $CO_2$, $H_2O$, and the like), and/or the like.

In one implementation, the second measurement station may be positioned in the same wellbore as the first measurement station, such that the second measurement station is positioned at a different depth than the first measurement station. Thus, the second DFA data may correspond to the same wellbore as the predicted DFA data. In another implementation, the second measurement station may be positioned in a different wellbore than the first measurement station. Thus, the second DFA data may correspond to a different wellbore than the predicted DFA data in what is presumed to be the same reservoir unit.

At block 950, the reservoir may be analyzed based on a comparison of the MGL data and a comparison of the second DFA data to the predicted DFA data. In one implementation, block 950 may be performed by one or more computer applications.

In comparing the second DFA data to the predicted DFA data, it may be assumed that the reservoir is connected and in thermodynamic equilibrium. Thus, the second DFA data may be used to confirm that they correspond to the expected reservoir architecture. In particular, connectivity (i.e., non-compartmentalization) of the reservoir can be indicated by moderately decreasing GOR values with increasing depth, a continuous increase of asphaltene content as a function of depth, a continuous increase of fluid density and/or fluid viscosity as a function of depth, and/or the like. Accordingly, the use of the EOS models to determine predicted DFA data may offer a baseline equilibrium for the reservoir against which the second DFA data can be compared.

If the second DFA data differs from the predicted DFA data by a threshold amount, it may then be determined that the reservoir is compartmentalized and/or in a non-equilibrium state. For example, compartmentalization and/or non-equilibrium can be indicated by a reversing trend in GOR (such as if lower GOR is found higher in the column), discontinuous asphaltene content (or if higher asphaltene content is found higher in the column), discontinuous fluid density and/or fluid viscosity (or if higher fluid density and/or fluid viscosity is found higher in the column), variations in fluid composition, fluid properties indicated by the second DFA data that are larger than those of the predicted DFA data, and/or the like. In one implementation, the threshold amount may be equal to an amount greater than or equal to a monotonic variation between the second DFA data and the predicted DFA data.

In one implementation, the MGL data may include a first MGL data and a second MGL data. In particular, the first MGL data may include MGL data determined at one or more depth intervals in the same wellbore as that of the predicted DFA data, such as at the first measurement station. The second MGL data may include MGL data determined at the second measurement station described above, where the second measurement station may also be located in the same wellbore as that of the predicted DFA data. In another implementation, the second measurement station may be located in a different wellbore than that of the predicted DFA data. Accordingly, to analyze the reservoir based on the MGL data of different spatial locations of the reservoir, the first MGL data may be compared to the second MGL data.

In one implementation, agreement between the second DFA data and the predicted DFA data may imply connectivity between the spatial locations, provided that the fluid samples obtained from the first and second measurement stations are in thermodynamic equilibrium and that the first MGL data and the second MGL data are consistent.

On the other hand, disagreement between the second DFA data and the predicted DFA data may be further investigated using a comparison of the first MGL data and the second MGL data to identify possible causes of the non-equilibrium. As noted above, such causes may include geologic events that may alter the reservoir structure after the primary charge, thermally mature fluids that may arrive to the reservoir, hydrocarbons that may escape via flow channels or a compromised cap seal, biodegradation at sufficiently low temperature and mixing with biogenic methane, biogenic methane arriving at the reservoir, water washing, and/or the like. In one implementation, the comparison between the first MGL data and the second MGL data may be used to identify the effects of thermogenic or biogenic origins of the reservoir fluid on non-equilibrium.

In one implementation, core analyses, mud logging analyses of drilled rock cuttings, basic petrophysical logs (gamma-ray, resistivity, and neutron-density), advanced petrophysical logs (elemental analysis logs, magnetic resonance logs, and porosity logs), and mobility measurements with a formation tester may be analyzed further to identify organic deposits in reservoir sections (e.g., tar mats or bitumen zones). In particular, DFA data and MGL data may be integrated with such analyses to provide information of field-wide or localized fluid instabilities, which may give rise to departures from the baseline thermodynamic equilibrium state and may provide information for field development planning.

In another implementation, method 900 may be repeated for additional measurement stations and/or wellbores to provide further analysis of reservoir compartmentalization and non-equilibrium.

EXAMPLES

Figure 10:
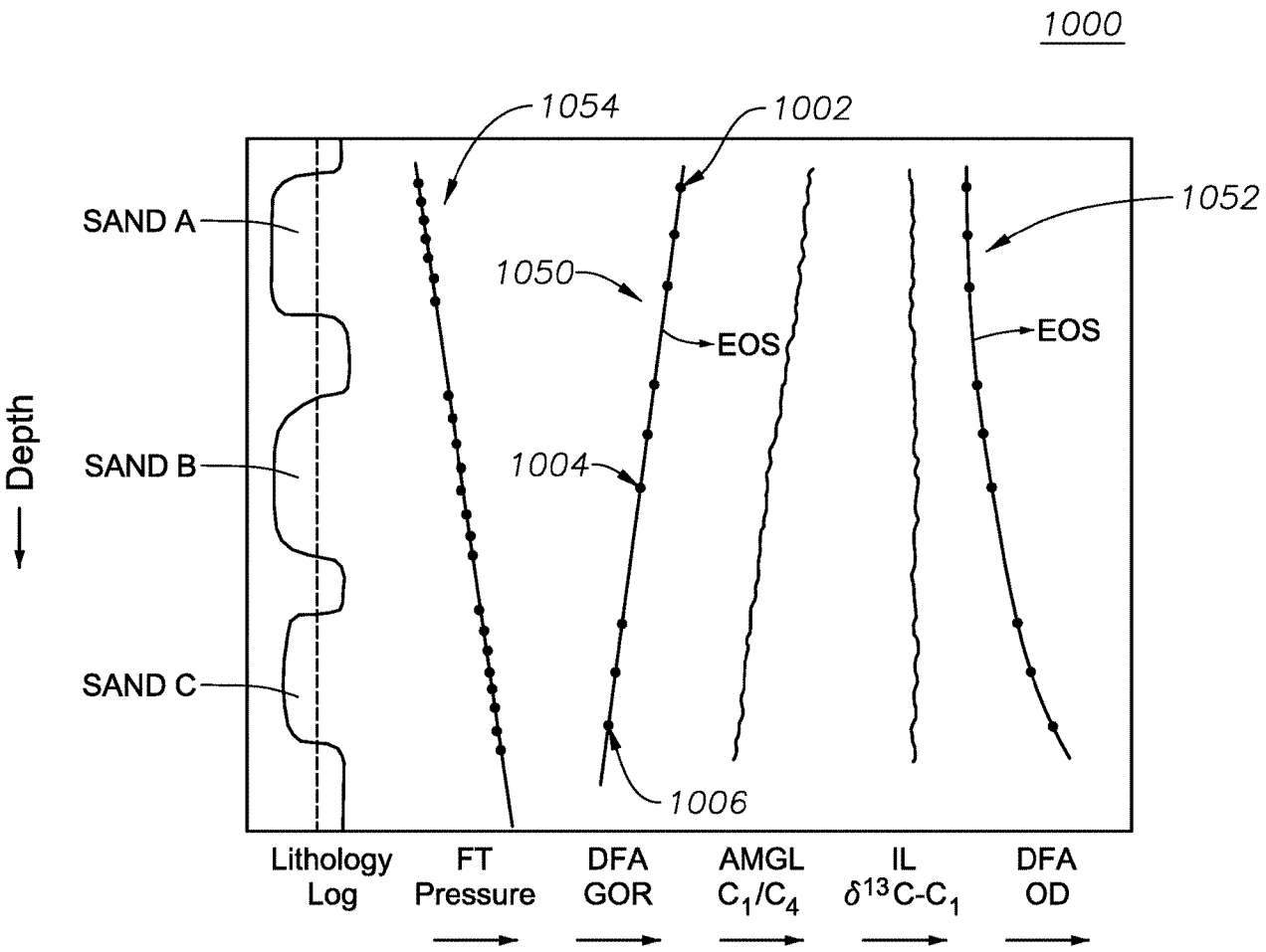
FIGS. 10-12 illustrate graphical representations of fluid properties of a reservoir in accordance with implementations of various technologies and techniques described herein.

FIG. 10 illustrates a graphical representation 1000 of fluid properties of a reservoir in accordance with implementations of various technologies and techniques described herein.

As shown, various fluid properties measured for a single wellbore of the reservoir are plotted, including pressure data, GOR, optical density (OD), fluid composition ratios (e.g. C2/iC4, C1/C4) derived using MGL, and isotopic compositions of gases (e.g. $\delta^{13}$C-C1) derived using isotope logging (IL). The GOR plot 1050 and the optical density plot 1052 may be derived using one or more EOS, as described above. Further, the graphical representation 1000 also includes a lithology log, which may be derived using gamma radiation measurements or any other technique known to those skilled in the art. The graphical representation 1000 also shows measured fluid properties corresponding to a first measurement station 1002, a second measurement station 1004, and a third measurement station 1006.

As shown, the lithology log may indicate the zones of interest, labeled as sands. Further, these zones may have higher porosity and permeability. This higher porosity and permeability may allow for the measurement of the sandface formation pressure using one or more of the downhole tools described with respect to FIGS. 5-7. In addition, the pressure data may align along a single gradient 1054, which may indicate a hydraulic connectivity among the sands.

Based on DFA data, or a combination of DFA and MGL data, corresponding to one or more reference points in the wellbore, one or more EOS models may be used to estimate GOR and optical density for the wellbore. As noted above, the estimated GOR is shown by plot 1050, and the estimated optical density is shown by plot 1052. As shown, GOR data and optical density data at stations 1002, 1004, and 1006 align with the plots 1050 and 1052, as they line up with the monotonic variation of the plots. Such alignment may indicate thermodynamic equilibrium, and hence connectivity among these sands. The MGL C1/C4 plot exhibits a monotonically decreasing trend, which may be consistent with the GOR measurement. The IL measurement remains substantially constant, which may indicate that the gas in the sands share the same source rock and are at the same maturity level, or the gas may have had time to equilibrate within the reservoir. Thus, it may be inferred that there are no processes acting on the reservoir, and the reservoir fluids may be in thermodynamic equilibrium.

Figure 11:
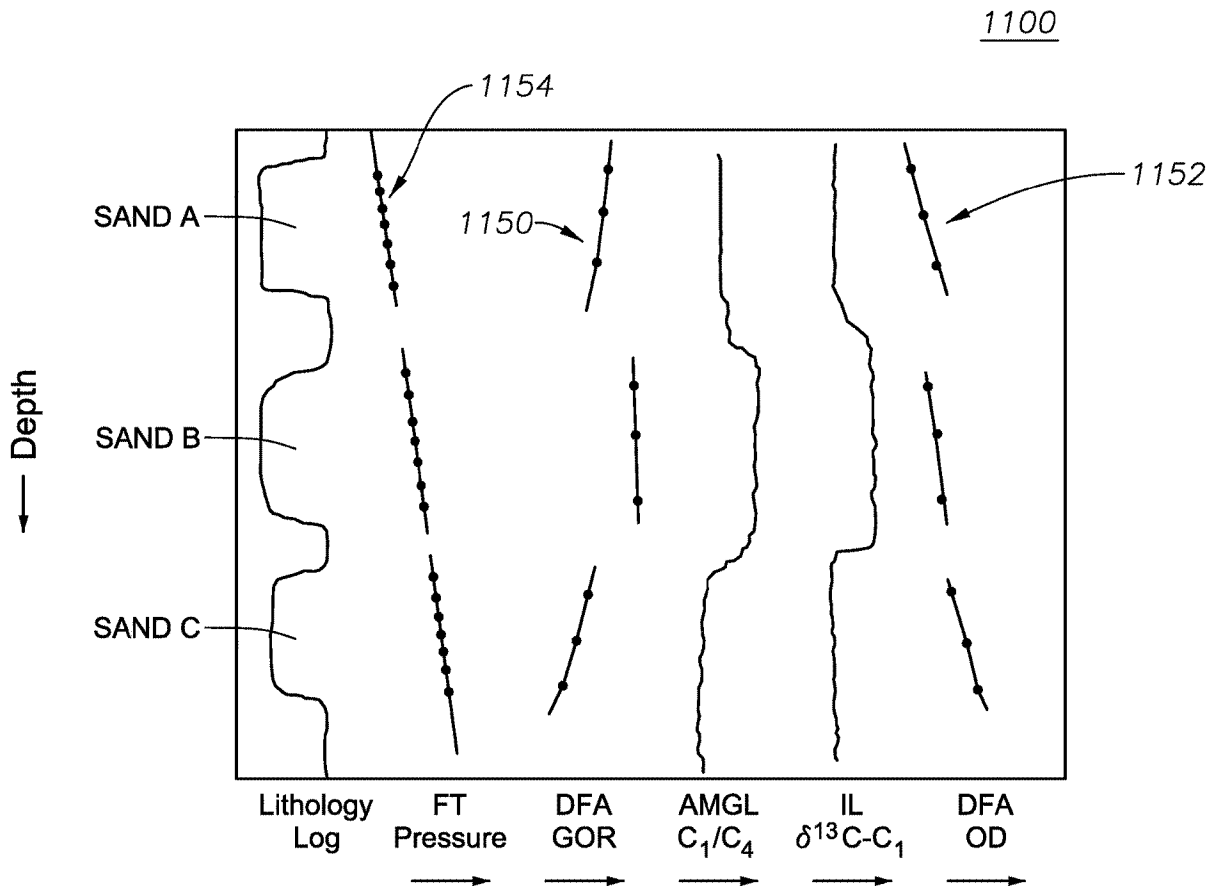

FIG. 11 illustrates a graphical representation 1100 of fluid properties of a reservoir in accordance with implementations of various technologies and techniques described herein.

Again, as shown, various fluid properties measured for a single wellbore of the reservoir are plotted, including pressure data, GOR, optical density, a fluid composition ratio (C2/iC4) derived using MGL, and isotopic compositions of C1 ($\delta^{13}$C-C1) derived using isotope logging (IL). Additionally, the GOR plot 1150 and the optical density plot 1152 may be derived using one or more EOS, as described above. Further, the graphical representation 1100 also includes a lithology log, which may be derived using gamma radiation measurements or any other technique known to those skilled in the art.

As shown, the pressure data seems to align with a constant gradient line 1154. However, in contrast to FIG. 10, other measurements may indicate a discontinuous fluid behavior. Here the GOR, MGL ratio (e.g. C2/iC4), and $\delta^{13}$C-C1 increase in sand B, whereas the optical density decreases. The change in the isotope logging plot in sand B could indicate that the gas has a different source, and therefore provides an explanation for the observed variations in the other fluid properties.

In one implementation, variations in fluid composition may be identified using MGL and/or IL, and then may be corroborated using DFA. In another implementation, certain fluid mixtures may exhibit minor variations in gas and/or liquid hydrocarbon components such that the fluid composition appears constant in a gas chromatography analysis (e.g., MGL, laboratory), but may exhibit variations in the concentration of solid petroleum fractions.

Figure 12:
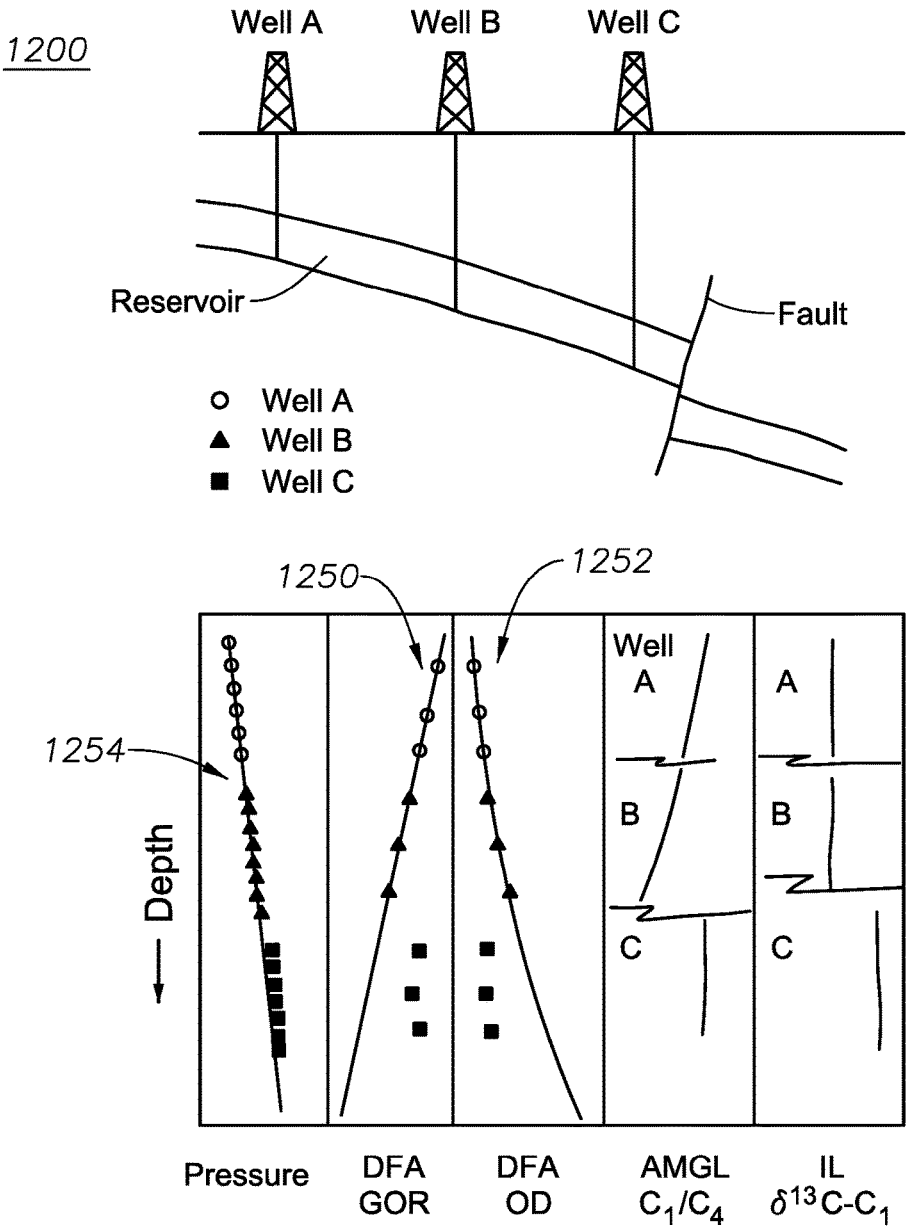

FIG. 12 illustrates a graphical representation 1200 of fluid properties of a reservoir in accordance with implementations of various technologies and techniques described herein.

As shown, various fluid properties measured for three wellbores of the reservoir are plotted, including pressure data, GOR, optical density, fluid composition ratio of C2/iC4 derived using MGL, and isotopic compositions of C1 ($\delta^{13}$C-C1) derived using isotope logging (IL). Additionally, the GOR plot 1250 and the optical density plot 1252 may be derived using one or more EOS, as described above.

In addition, as shown, the pressure data appears to align to the same gradient 1254, while fluid properties (GOR and optical density) of wells A and B align with the equilibrium state of the reservoir fluid. However the fluid from well C may be different. Given the difference in plots fluid composition ratio of C2/iC4 derived using MGL, and $\delta^{13}$C-C1 derived using IL for well C relative to the other wells, it may be understood that well C is may still be in hydraulic communication with wells A and B. Accordingly, well C may not be compartmentalized from wells A and B, though the system may not be in thermodynamic equilibrium. One possible interpretation for this situation is that the reservoir near well C may have received a recent gas charge (possibly through the nearby fault), and thus the fluid in this region may not be in thermodynamic equilibrium.

In sum, the implementations for analyzing a reservoir using fluid analysis, described above with respect to FIGS. 1-12 above, may provide information that can be used to detect compartmentalization and/or non-equilibrium hydrocarbon distribution in a reservoir of interest. In particular, the integration of downhole fluid analysis and mud gas logging may be used to identify possible causes of the non-equilibrium hydrocarbon distribution in the reservoir.

In some implementations, a method for analyzing a reservoir using fluid analysis may be provided. The method may determine mud gas logging (MGL) data based on drilling mud associated with a wellbore traversing a reservoir of interest. The method may determine first downhole fluid analysis (DFA) data based on a first reservoir fluid sample obtained at a first measurement station in the wellbore. The method may determine predicted DFA data for the wellbore based on the first DFA data. The method may determine second DFA data based on a second reservoir fluid sample obtained at a second measurement station in the wellbore. The method may analyze the reservoir based on a comparison of the MGL data and a comparison of the second DFA data to the predicted DFA data.

In some implementations, the method may determine the predicted DFA data using one or more equations of state (EOS) models of thermodynamic behavior of reservoir fluid. The method may determine the predicted DFA data using one or more equations of state (EOS) models of thermodynamic behavior of reservoir fluid based on the first DFA data and the MGL data. The method may determine predicted DFA data for one or more depth locations in the wellbore. The method may compare first MGL data corresponding to the first measurement station to second MGL data corresponding to the second measurement station. The method may also use a comparison of the first MGL data and the second MGL data to identify one or more causes of a non-equilibrium state of the reservoir. The one or more clauses may be selected from a group consisting of one or more geologic events altering a structure of the reservoir structure, thermally mature fluids arriving into the reservoir, hydrocarbons escaping via flow channels or a compromised cap seal of the reservoir, biodegradation and mixing with biogenic methane in the reservoir, biogenic methane arriving at the reservoir, and water washing. The method may determine that the reservoir is compartmentalized and in a non-equilibrium state if the second DFA data differs from the predicted DFA data by a threshold amount. The threshold amount may correspond to an amount greater than or equal to a monotonic variation between the second DFA data and the predicted DFA data. The MGL data may include a quantitative composition of hydrocarbons in gas extracted from the drilling mud. The MGL data may include isotope logging data. The isotope logging data may be based on spot mud gas samples of the drilling mud. The first DFA data may include one or more measurements of gas-oil ratio (GOR), fluid composition, acidity, fluorescence, optical density, fluid resistivity, fluid density, fluid viscosity, temperature, pressure, or combinations thereof.

In some implementations, an information processing apparatus for use in a computing system is provided, and includes means for determining mud gas logging (MGL) data based on drilling mud associated with a wellbore traversing a reservoir of interest. The information processing apparatus may also have means for determining first downhole fluid analysis (DFA) data based on a first reservoir fluid sample obtained at a first measurement station in the wellbore. The information processing apparatus may further have means for determining predicted DFA data for the wellbore based on the first DFA data. The information processing apparatus may additionally have means for determine second DFA data based on a second reservoir fluid sample obtained at a second measurement station in the wellbore. The information processing apparatus may further have means for analyze the reservoir based on a comparison of the MGL data and a comparison of the second DFA data to the predicted DFA data.

In some implementations, a computing system is provided that includes at least one processor, at least one memory, and one or more programs stored in the at least one memory, wherein the programs may include instructions, which when executed by the at least one processor cause the computing system to determine mud gas logging (MGL) data based on drilling mud associated with a wellbore traversing a reservoir of interest. The programs may further include instructions to cause the computing system to determine first downhole fluid analysis (DFA) data based on a first reservoir fluid sample obtained at a first measurement station in the wellbore. The programs may further include instructions to cause the computing system to determine predicted DFA data for the wellbore based on the first DFA data. The programs may further include instructions to cause the computing system to determine second DFA data based on a second reservoir fluid sample obtained at a second measurement station in the wellbore. The programs may further include instructions to cause the computing system to analyze the reservoir based on a comparison of the MGL data and a comparison of the second DFA data to the predicted DFA data.

In some implementations, a computer readable storage medium is provided, which has stored therein one or more programs, the one or more programs including instructions, which when executed by a processor, may cause the processor to determine mud gas logging (MGL) data based on drilling mud associated with a wellbore traversing a reservoir of interest. The programs may further include instructions, which cause the processor to determine first downhole fluid analysis (DFA) data based on a first reservoir fluid sample obtained at a first measurement station in the wellbore. The programs may further include instructions, which cause the processor to determine predicted DFA data for the wellbore based on the first DFA data. The programs may further include instructions, which cause the processor to determine second DFA data based on a second reservoir fluid sample obtained at a second measurement station in the wellbore. The programs may further include instructions, which cause the processor to analyze the reservoir based on a comparison of the MGL data and a comparison of the second DFA data to the predicted DFA data.

In some implementations, a well site for analyzing a reservoir using fluid analysis may be provided. The well site may include one or more degassers configured to extract gas from drilling mud associated with a wellbore traversing a reservoir of interest. The well site may include one or more gas analyzers configured to interact with the one or more degassers and to generate data relating to the extracted gas. The well site may include one or more downhole tools configured to obtain a first reservoir fluid sample at a first measurement station in the wellbore and a second reservoir fluid sample at a second measurement station in the wellbore. The well site may include one or more computing systems, having a processor and a memory. The memory may include a plurality of program instructions which, when executed by the processor, cause the processor to determine mud gas logging (MGL) data based on the data relating to the extracted gas. The program instructions which, when executed by the processor, may also cause the processor to determine first downhole fluid analysis (DFA) data based on the first reservoir fluid sample. The program instructions which, when executed by the processor, may further cause the processor to determine predicted DFA data for the first wellbore based on the first DFA data. The program instructions which, when executed by the processor, may also cause the processor to determine second DFA data based on the second reservoir fluid sample. The program instructions which, when executed by the processor, may also cause the processor to analyze the reservoir based on a comparison of the MGL data and a comparison of the second DFA data to the predicted DFA data.

In some implementations, the program instructions which, when executed by the processor, may also cause the processor to determine the predicted DFA data using one or more equations of state (EOS) models of thermodynamic behavior of reservoir fluid. The program instructions which, when executed by the processor, may also cause the processor to determine that the reservoir is compartmentalized and in a non-equilibrium state if the second DFA data differs from the predicted DFA data by a threshold amount.

In some implementations, a method may be provided. The method may determine mud gas logging (MGL) data based on the data relating to the extracted gas. The method may also determine first downhole fluid analysis (DFA) data based on the first reservoir fluid sample. The method may further determine predicted DFA data for the first wellbore based on the first DFA data. The method may also determine second DFA data based on the second reservoir fluid sample. The method may further analyze the reservoir based on a comparison of the MGL data and a comparison of the second DFA data to the predicted DFA data.

In some implementations, an information processing apparatus for use in a computing system is provided, and includes means for determining mud gas logging (MGL) data based on the data relating to the extracted gas. The information processing apparatus may also have means for determining first downhole fluid analysis (DFA) data based on the first reservoir fluid sample. The information processing apparatus may also have means for determining predicted DFA data for the first wellbore based on the first DFA data. The information processing apparatus may also have means for determining second DFA data based on the second reservoir fluid sample. The information processing apparatus may also have means for analyzing the reservoir based on a comparison of the MGL data and a comparison of the second DFA data to the predicted DFA data.

In some implementations, a computer readable storage medium is provided, which has stored therein one or more programs, the one or more programs including instructions, which when executed by a processor, cause the processor to determine mud gas logging (MGL) data based on the data relating to the extracted gas. The programs may further include instructions, which cause the processor to determine first downhole fluid analysis (DFA) data based on the first reservoir fluid sample. The programs may further include instructions, which cause the processor to determine predicted DFA data for the first wellbore based on the first DFA data. The programs may further include instructions, which cause the processor to determine second DFA data based on the second reservoir fluid sample. The programs may further include instructions, which cause the processor to analyze the reservoir based on a comparison of the MGL data and a comparison of the second DFA data to the predicted DFA data.

In some implementations, another method for analyzing a reservoir using fluid analysis may be provided. The method may determine mud gas logging (MGL) data based on drilling mud associated with a first wellbore and a second wellbore both traversing a reservoir of interest. The method may also determine first downhole fluid analysis (DFA) data based on a first reservoir fluid sample obtained at a first measurement station in a first wellbore. The method may further determine predicted DFA data for the first wellbore based on the first DFA data. The method may also determine second DFA data based on a second reservoir fluid sample obtained at a second measurement station in a second wellbore. The method may further analyze the reservoir based on a comparison of the MGL data and a comparison of the second DFA data to the predicted DFA data.

In some implementation, the method may determine the predicted DFA data using one or more equations of state (EOS) models of thermodynamic behavior of reservoir fluid. The method may compare first MGL data corresponding to the first measurement station to second MGL data corresponding to the second measurement station. The method may determine that the reservoir is compartmentalized and in a non-equilibrium state if the second DFA data differs from the predicted DFA data by a threshold amount.

In some implementations, an information processing apparatus for use in a computing system is provided, and includes means for determining mud gas logging (MGL) data based on drilling mud associated with a first wellbore and a second wellbore both traversing a reservoir of interest. The information processing apparatus may also have means for determining first downhole fluid analysis (DFA) data based on a first reservoir fluid sample obtained at a first measurement station in a first wellbore. The information processing apparatus may also have means for determining predicted DFA data for the first wellbore based on the first DFA data. The information processing apparatus may also have means for determining second DFA data based on a second reservoir fluid sample obtained at a second measurement station in a second wellbore. The information processing apparatus may also have means for analyzing the reservoir based on a comparison of the MGL data and a comparison of the second DFA data to the predicted DFA data.

In some implementations, a computing system is provided that includes at least one processor, at least one memory, and one or more programs stored in the at least one memory, wherein the programs include instructions, which when executed by the at least one processor cause the computing system to determine mud gas logging (MGL) data based on drilling mud associated with a first wellbore and a second wellbore both traversing a reservoir of interest. The programs may further include instructions to cause the computing system to determine first downhole fluid analysis (DFA) data based on a first reservoir fluid sample obtained at a first measurement station in a first wellbore. The programs may further include instructions to cause the computing system to determine predicted DFA data for the first wellbore based on the first DFA data. The programs may further include instructions to cause the computing system to determine second DFA data based on a second reservoir fluid sample obtained at a second measurement station in a second wellbore. The programs may further include instructions to cause the computing system to analyze the reservoir based on a comparison of the MGL data and a comparison of the second DFA data to the predicted DFA data.

In some implementations, a computer readable storage medium is provided, which has stored therein one or more programs, the one or more programs including instructions, which when executed by a processor, cause the processor to determine mud gas logging (MGL) data based on drilling mud associated with a first wellbore and a second wellbore both traversing a reservoir of interest. The programs may further include instructions, which cause the processor to determine first downhole fluid analysis (DFA) data based on a first reservoir fluid sample obtained at a first measurement station in a first wellbore. The programs may further include instructions, which cause the processor to determine predicted DFA data for the first wellbore based on the first DFA data. The programs may further include instructions, which cause the processor to determine second DFA data based on a second reservoir fluid sample obtained at a second measurement station in a second wellbore. The programs may further include instructions, which cause the processor to analyze the reservoir based on a comparison of the MGL data and a comparison of the second DFA data to the predicted DFA data.

Computing Systems

Implementations of various technologies described herein may be operational with numerous general purpose or special purpose computing system environments or configurations. Examples of well known computing systems, environments, and/or configurations that may be suitable for use with the various technologies described herein include, but are not limited to, personal computers, server computers, hand-held or laptop devices, multiprocessor systems, microprocessor-based systems, set top boxes, programmable consumer electronics, network PCs, minicomputers, mainframe computers, smart phones, smart watches, personal wearable computing systems networked with other computing systems, tablet computers, and distributed computing environments that include any of the above systems or devices, and the like.

The various technologies described herein may be implemented in the general context of computer-executable instructions, such as program modules, being executed by a computer. Generally, program modules include routines, programs, objects, components, data structures, etc. that performs particular tasks or implement particular abstract data types. While program modules may execute on a single computing system, it should be appreciated that, in some implementations, program modules may be implemented on separate computing systems or devices adapted to communicate with one another. A program module may also be some combination of hardware and software where particular tasks performed by the program module may be done either through hardware, software, or both.

The various technologies described herein may also be implemented in distributed computing environments where tasks are performed by remote processing devices that are linked through a communications network, e.g., by hardwired links, wireless links, or combinations thereof. The distributed computing environments may span multiple continents and multiple vessels, ships or boats. In a distributed computing environment, program modules may be located in both local and remote computer storage media including memory storage devices.

Figure 13:
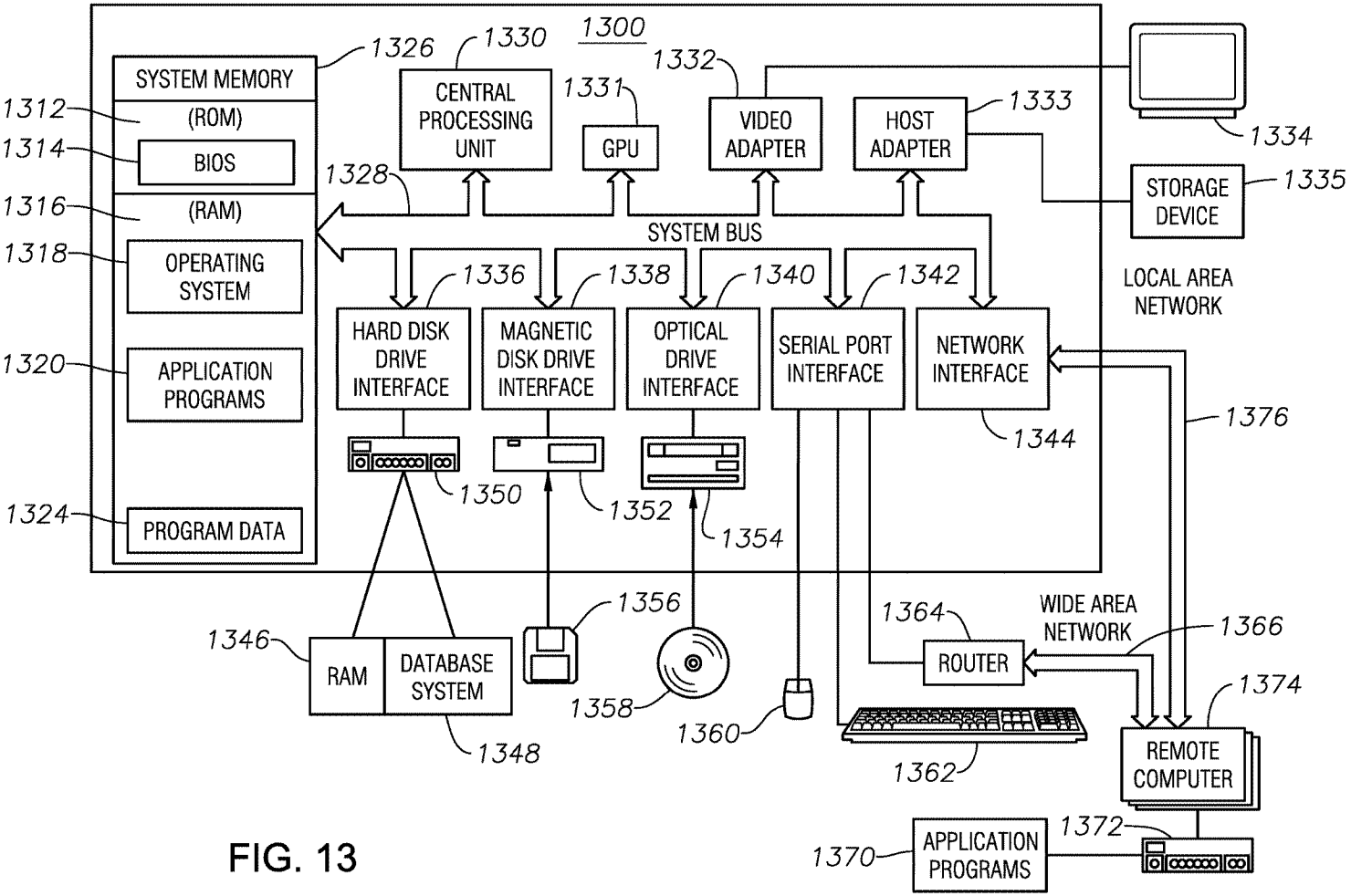
FIG. 13 illustrates a computing system in which various implementations of various techniques described herein may be implemented.

FIG. 13 illustrates a schematic diagram of a computing system 1300 in which the various technologies described herein may be incorporated and practiced. Although the computing system 1300 may be a conventional desktop or a server computer, as described above, other computer system configurations may be used.

The computing system 1300 may include a central processing unit (CPU) 1330, a system memory 1326, a graphics processing unit (GPU) 1331 and a system bus 1328 that couples various system components including the system memory 1326 to the CPU 1330. Although one CPU is illustrated in FIG. 13, it should be understood that in some implementations the computing system 1300 may include more than one CPU. The GPU 1331 may be a microprocessor specifically designed to manipulate and implement computer graphics. The CPU 1330 may offload work to the GPU 1331. The GPU 1331 may have its own graphics memory, and/or may have access to a portion of the system memory 1326. As with the CPU 1330, the GPU 1331 may include one or more processing units, and the processing units may include one or more cores. The system bus 1328 may be any of several types of bus structures, including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus. The system memory 1326 may include a read-only memory (ROM) 1312 and a random access memory (RAM) 1346. A basic input/output system (BIOS) 1314, containing the basic routines that help transfer information between elements within the computing system 1300, such as during start-up, may be stored in the ROM 1312.

The computing system 1300 may further include a hard disk drive 1350 for reading from and writing to a hard disk, a magnetic disk drive 1352 for reading from and writing to a removable magnetic disk 1356, and an optical disk drive 1354 for reading from and writing to a removable optical disk 1358, such as a CD ROM or other optical media. The hard disk drive 1350, the magnetic disk drive 1352, and the optical disk drive 1354 may be connected to the system bus 1328 by a hard disk drive interface 1356, a magnetic disk drive interface 1358, and an optical drive interface 1350, respectively. The drives and their associated computer-readable media may provide nonvolatile storage of computer-readable instructions, data structures, program modules and other data for the computing system 1300.

Although the computing system 1300 is described herein as having a hard disk, a removable magnetic disk 1356 and a removable optical disk 1358, it should be appreciated by those skilled in the art that the computing system 1300 may also include other types of computer-readable media that may be accessed by a computer. For example, such computer-readable media may include computer storage media and communication media. Computer storage media may include volatile and non-volatile, and removable and nonremovable media implemented in any method or technology for storage of information, such as computer-readable instructions, data structures, program modules or other data. Computer storage media may further include RAM, ROM, erasable programmable read-only memory (EPROM), electrically erasable programmable read-only memory (EEPROM), flash memory or other solid state memory technology, CD-ROM, digital versatile disks (DVD), or other optical storage, magnetic cassettes, magnetic tape, magnetic disk storage or other magnetic storage devices, or any other medium which can be used to store the desired information and which can be accessed by the computing system 1300. Communication media may embody computer readable instructions, data structures, program modules or other data in a modulated data signal, such as a carrier wave or other transport mechanism and may include any information delivery media. The term "modulated data signal" may mean a signal that has one or more of its characteristics set or changed in such a manner as to encode information in the signal. By way of example, and not limitation, communication media may include wired media such as a wired network or direct-wired connection, and wireless media such as acoustic, RF, infrared and other wireless media. The computing system 1300 may also include a host adapter 1333 that connects to a storage device 1335 via a small computer system interface (SCSI) bus, a Fiber Channel bus, an eSATA bus, or using any other applicable computer bus interface. Combinations of any of the above may also be included within the scope of computer readable media.

A number of program modules may be stored on the hard disk 1350, magnetic disk 1356, optical disk 1358, ROM 1312 or RAM 1316, including an operating system 1318, one or more application programs 1320, program data 1324, and a database system 1348. The application programs 1320 may include various mobile applications ("apps") and other applications configured to perform various methods and techniques described herein. The operating system 1318 may be any suitable operating system that may control the operation of a networked personal or server computer, such as Windows® XP, Mac OS® X, Unix-variants (e.g., Linux® and BSD®), and the like.

A user may enter commands and information into the computing system 1300 through input devices such as a keyboard 1362 and pointing device 1360. Other input devices may include a microphone, joystick, game pad, satellite dish, scanner, or the like. These and other input devices may be connected to the CPU 1330 through a serial port interface 1342 coupled to system bus 1328, but may be connected by other interfaces, such as a parallel port, game port or a universal serial bus (USB). A monitor 1334 or other type of display device may also be connected to system bus 1328 via an interface, such as a video adapter 1332. In addition to the monitor 1334, the computing system 1300 may further include other peripheral output devices such as speakers and printers.

Further, the computing system 1300 may operate in a networked environment using logical connections to one or more remote computers 1374. The logical connections may be any connection that is commonplace in offices, enterprise-wide computer networks, intranets, and the Internet, such as local area network (LAN) 1356 and a wide area network (WAN) 1366. The remote computers 1374 may be another a computer, a server computer, a router, a network PC, a peer device or other common network node, and may include many of the elements describes above relative to the computing system 1300. The remote computers 1374 may also each include application programs 1370 similar to that of the computer action function.

When using a LAN networking environment, the computing system 1300 may be connected to the local network 1376 through a network interface or adapter 1344. When used in a WAN networking environment, the computing system 1300 may include a router 1364, wireless router or other means for establishing communication over a wide area network 1366, such as the Internet. The router 1364, which may be internal or external, may be connected to the system bus 1328 via the serial port interface 1352. In a networked environment, program modules depicted relative to the computing system 1300, or portions thereof, may be stored in a remote memory storage device 1372. It will be appreciated that the network connections shown are merely examples and other means of establishing a communications link between the computers may be used.

The network interface 1344 may also utilize remote access technologies (e.g., Remote Access Service (RAS), Virtual Private Networking (VPN), Secure Socket Layer (SSL), Layer 2 Tunneling (L2T), or any other suitable protocol). These remote access technologies may be implemented in connection with the remote computers 1374.

It should be understood that the various technologies described herein may be implemented in connection with hardware, software or a combination of both. Thus, various technologies, or certain aspects or portions thereof, may take the form of program code (i.e., instructions) embodied in tangible media, such as floppy diskettes, CD-ROMs, hard drives, or any other machine-readable storage medium wherein, when the program code is loaded into and executed by a machine, such as a computer, the machine becomes an apparatus for practicing the various technologies. In the case of program code execution on programmable computers, the computing device may include a processor, a storage medium readable by the processor (including volatile and non-volatile memory and/or storage elements), at least one input device, and at least one output device. One or more programs that may implement or utilize the various technologies described herein may use an application programming interface (API), reusable controls, and the like. Such programs may be implemented in a high level procedural or object oriented programming language to communicate with a computer system. However, the program(s) may be implemented in assembly or machine language, if desired. In any case, the language may be a compiled or interpreted language, and combined with hardware implementations. Also, the program code may execute entirely on a user's computing device, on the user's computing device, as a stand-alone software package, on the user's computer and on a remote computer or entirely on the remote computer or a server computer.

The system computer 1300 may be located at a data center remote from the survey region. The system computer 1300 may be in communication with the receivers (either directly or via a recording unit, not shown), to receive signals indicative of the reflected seismic energy. These signals, after conventional formatting and other initial processing, may be stored by the system computer 1300 as digital data in the disk storage for subsequent retrieval and processing in the manner described above. In one implementation, these signals and data may be sent to the system computer 1300 directly from sensors, such as geophones, hydrophones and the like. When receiving data directly from the sensors, the system computer 1300 may be described as part of an in-field data processing system. In another implementation, the system computer 1300 may process seismic data already stored in the disk storage. When processing data stored in the disk storage, the system computer 1300 may be described as part of a remote data processing center, separate from data acquisition. The system computer 1300 may be configured to process data as part of the in-field data processing system, the remote data processing system or a combination thereof.

Those with skill in the art will appreciate that any of the listed architectures, features or standards discussed above with respect to the example computing system 1300 may be omitted for use with a computing system used in accordance with the various embodiments disclosed herein because technology and standards continue to evolve over time.

Of course, many processing techniques for collected data, including one or more of the techniques and methods disclosed herein, may also be used successfully with collected data types other than seismic data. While certain implementations have been disclosed in the context of seismic data collection and processing, those with skill in the art will recognize that one or more of the methods, techniques, and computing systems disclosed herein can be applied in many fields and contexts where data involving structures arrayed in a three-dimensional space and/or subsurface region of interest may be collected and processed, e.g., medical imaging techniques such as tomography, ultrasound, MRI and the like for human tissue; radar, sonar, and LIDAR imaging techniques; and other appropriate three-dimensional imaging problems.

While the foregoing is directed to implementations of various technologies described herein, other and further implementations may be devised without departing from the basic scope thereof. Although the subject matter has been described in language specific to structural features and/or methodological acts, it is to be understood that the subject matter defined in the appended claims is not limited to the specific features or acts described above. Rather, the specific features and acts described above are disclosed as example forms of implementing the claims.

What is claimed is:

1. A method, comprising:

determining formation pressure data in a region of interest wherein the region of interest comprises gas;

analyzing a spatial gradient of the formation pressure for an indication of connectivity in the region of interest; and responsive to the indication of connectivity in the region of interest:

determining mud gas logging (MGL) data based on wellbore drilling mud in the region of interest;

determining first downhole fluid analysis (DFA) data based on a first fluid sample obtained at a first wellbore measurement station in the region of interest;

determining predicted DFA data based on the first DFA data;

determining second DFA data based on a second fluid sample obtained at a second wellbore measurement station in the region of interest;

analyzing the region of interest based on a comparison of the MGL data and a comparison of the second DFA data to the predicted DFA data; and based at least in part on the analyzing, determining at least one additional spatial gradient in the region of interest that characterizes the region of interest with respect to thermodynamic equilibrium of fluid in the region of interest, wherein, if the second DFA data differ from the predicted DFA data by a threshold amount, determining that the region of interest is compartmentalized and in a non-equilibrium state and determining that a spatial difference in the MGL data indicates that the gas in the compartmentalized region of interest comprises at least two different sources.

2. The method of claim 1, wherein determining predicted DFA data based on the first DFA data comprises:

determining the predicted DFA data using one or more equations of state (EOS) models of thermodynamic behavior of fluid in the region of interest.

3. The method of claim 1, wherein determining predicted DFA data based on the first DFA data comprises:

determining the predicted DFA data using one or more equations of state (EOS) models of thermodynamic behavior of fluid in the region of interest based on the first DFA data and the MGL data.

4. The method of claim 1, wherein determining predicted DFA data based on the first DFA data comprises:

determining predicted DFA data for one or more depth locations in a wellbore.

5. The method of claim 1, wherein analyzing the region of interest based on the comparison of the MGL data comprises:

comparing first MGL data corresponding to the first wellbore measurement station to second MGL data corresponding to the second wellbore measurement station.

6. The method of claim 5, further comprising:

using a comparison of the first MGL data and the second MGL data to identify one or more causes of the non-equilibrium state of the fluid in the region of interest.

7. The method of claim 6, wherein the one or more causes are selected from a group consisting of:

one or more geologic events altering a structure of the region of interest;

thermally mature fluids arriving into the region of interest;

hydrocarbons escaping via flow channels or a compromised cap seal of the region of interest;

biodegradation and mixing with biogenic methane in the region of interest;

biogenic methane arriving in the region of interest; and water washing.

8. The method of claim 1, wherein the threshold amount corresponds to an amount greater than or equal to a monotonic variation between the second DFA data and the predicted DFA data.

9. The method of claim 1, wherein the MGL data comprise a quantitative composition of hydrocarbons in gas extracted from the drilling mud.

10. The method of claim 1, wherein the MGL data comprises isotope logging data.

11. The method of claim 10, wherein the isotope logging data is based on spot mud gas samples of the drilling mud.

12. The method of claim 1, wherein the first DFA data comprise one or more measurements of gas-oil ratio (GOR), fluid composition, acidity, fluorescence, optical density, fluid resistivity, fluid density, fluid viscosity, temperature, pressure, or combinations thereof.

13. A system, comprising:

one or more degassers configured to extract gas from wellbore drilling mud of a region of interest;

one or more gas analyzers configured to interact with the one or more degassers and to generate data relating to the extracted gas;

one or more downhole tools configured to obtain a first fluid sample at a first wellbore measurement station in the region of interest and a second fluid sample at a second wellbore measurement station in the region of interest;

one or more computing systems, comprising:

a processor; and a memory comprising a plurality of program instructions which, when executed by the processor, cause the processor to:

determine formation pressure data in the region of interest wherein the region of interest comprises gas;

analyze a spatial gradient of the formation pressure for an indication of connectivity in the region of interest; and responsive to the indication of connectivity in the region of interest:

determine mud gas logging (MGL) data based on the data relating to the extracted gas;

determine first downhole fluid analysis (DFA) data based on the first fluid sample;

determine predicted DFA data based on the first DFA data;

determine second DFA data based on the second fluid sample;

perform an analysis of the region of interest based on a comparison of the MGL data and a comparison of the second DFA data to the predicted DFA data; and based at least in part on analysis, determine at least one additional spatial gradient in the region of interest that characterizes the region of interest with respect to thermodynamic equilibrium of fluid in the region of interest, wherein, if the second DFA data differ from the predicted DFA data by a threshold amount, determine that the region of interest is compartmentalized and in a non-equilibrium state and determine that a spatial difference in the MGL data indicates that the gas in the compartmentalized region of interest comprises at least two different sources.

14. The well site system of claim 13, wherein the program instructions which cause the processor to determine the predicted DFA data based on the first DFA data further comprises program instructions which, when executed by the processor, cause the processor to:

determine the predicted DFA data using one or more equations of state (EOS) models of thermodynamic behavior of fluid in the region of interest.

15. The method of claim 1, wherein determining mud gas logging (MGL) data based on wellbore drilling mud is associated with a first wellbore and a second wellbore both traversing the region of interest;

wherein the first wellbore measurement station is in the first wellbore; and wherein the second wellbore measurement station is in the second wellbore.

16. The method of claim 15, wherein determining predicted DFA data based on the first DFA data further comprises:

determining the predicted DFA data using one or more equations of state (EOS) models of thermodynamic behavior of fluid in the region of interest.

17. The method of claim 15, wherein analyzing the region of interest based on the comparison of the MGL data comprises:

comparing first MGL data corresponding to the first wellbore measurement station in the first wellbore to second MGL data corresponding to the second wellbore measurement station in the second wellbore.

18. One or more non-transitory computer-readable media that comprise computer-executable instructions that are executable to instruct a computing system to:

determine formation pressure data in the region of interest wherein the region of interest comprises gas;

analyze a spatial gradient of the formation pressure for an indication of connectivity in the region of interest; and responsive to the indication of connectivity in the region of interest:

determine mud gas logging (MGL) data based on wellbore drilling mud in a region of interest;

determine first downhole fluid analysis (DFA) data based on a first fluid sample obtained at a first wellbore measurement station in the region of interest;

determine predicted DFA data based on the first DFA data;

determine second DFA data based on a second fluid sample obtained at a second wellbore measurement station in the region of interest;

perform an analysis of the region of interest based on a comparison of the MGL data and a comparison of the second DFA data to the predicted DFA data; and based at least in part on the analysis, determine at least one additional spatial gradient in the region of interest that characterizes the region of interest with respect to thermodynamic equilibrium of fluid in the region of interest, wherein, if the second DFA data differ from the predicted DFA data by a threshold amount, determine that the region of interest is compartmentalized and in a non-equilibrium state and determine that a spatial difference in the MGL data indicates that the gas in the compartmentalized region of interest comprises at least two different sources.

* * * * *